US008768231B2

(12) United States Patent
Fujita et al.

(10) Patent No.: US 8,768,231 B2
(45) Date of Patent: Jul. 1, 2014

(54) IMAGE FORMING METHOD AND IMAGE FORMING APPARATUS

(75) Inventors: Michiyo Fujita, Tokyo (JP); Tatsuya Nagase, Tokyo (JP); Asao Matsushima, Tokyo (JP); Yasuko Uchino, Tokyo (JP); Aya Shirai, Tokyo (JP); Ryuichi Hiramoto, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 344 days.

(21) Appl. No.: 13/297,372

(22) Filed: Nov. 16, 2011

(65) Prior Publication Data

US 2012/0128393 A1 May 24, 2012

(30) Foreign Application Priority Data

Nov. 22, 2010 (JP) ..... 2010-259860

(51) Int. Cl.
*G03G 15/20* (2006.01)

(52) U.S. Cl.
USPC ..... 399/341

(58) Field of Classification Search
USPC ..... 399/107, 110, 121, 122, 320, 328, 341
See application file for complete search history.

(56) References Cited

U.S. PATENT DOCUMENTS 7,024,149 B2 * 4/2006 Kito et al. ..... 399/341
8,145,115 B2 * 3/2012 Yamanouchi et al. ..... 399/342

FOREIGN PATENT DOCUMENTS

JP 11-007174 1/1999
JP 2002-341619 11/2002
JP 2003-316192 11/2003
JP 2007-140037 6/2007

* cited by examiner

*Primary Examiner* — Hoan Tran
(74) *Attorney, Agent, or Firm* — Lucas & Mercanti, LLP

(57) ABSTRACT

The image forming method including steps of forming a clear toner layer on a photoreceptor, transferring the clear toner layer onto a transfer member, transferring the clear toner layer on the transfer member onto an image support, heating the image support having the clear toner layer, bringing the clear toner layer into close contact with a belt to cool the image support, and separating the image support from the belt are provided, in this order; and the clear toner layer is formed with a plurality of independent linear protrusion portions and the independent linear protrusion portions are formed parallel or diagonally to the conveyance direction of an image support.

8 Claims, 10 Drawing Sheets

IMAGE FORMING METHOD AND IMAGE FORMING APPARATUS

This application is based on Japanese Patent Application No. 2010-259860 filed on Nov. 22, 2010, in Japanese Patent Office, the entire content of which is hereby incorporated by reference.

TECHNICAL FIELD

The present invention relates to an image forming method in which a glossy surface is formed using a colorless, transparent toner referred to as a clear toner on an image having been formed by an image forming method such as an electrophotographic method, an ink-jet method, or a printing method, and an image forming apparatus.

BACKGROUND

Over recent years, with the development of digital processing technology, print images represented by photographic images and posters have been also able to be produced using an ink-jet apparatus or an electrophotographic image forming apparatus, in addition to the conventional silver halide photographic method and the conventional printing method such as gravure printing. In printed matter such as photographic images and posters produced using such an image forming apparatus, those finished by forming a uniform glossy surface over the entire image support area are demanded in some cases.

As a technique to form a uniform glossy surface over the entire image support area, there is a technique to form a glossy surface using, for example, a toner having no colorant component referred to as a clear toner or a transparent toner. Specifically, a clear toner is fed in a layered manner onto an image support in which image formation has been carried out using a toner or an ink-jet printer, followed by heating and cooling to form a glossy surface having uniform glossiness over the entire image support area (for example, refer to Patent Document 1). In this manner, formation of a uniform glossy surface over the entire image support area has become one of the effective methods to enhance the added value of printed matter.

In the above technique to form a uniform glossy surface (hereinafter referred to also as a clear toner layer) on an image support using a clear toner, a device referred to as a glossy surface forming device is used. In this device, an image is formed using an image forming apparatus such as a printer and then an image support to which a clear toner has been fed is heated to melt the clear toner. Then, via the melted clear toner, the image support is brought into close contact with a belt member. Subsequently, the image support is cooled in the state of being in close contact with the belt member to cure the clear toner. The thus-cured clear toner is peeled from the belt member to form a glossy surface on the image support (for example, refer to Patent Documents 2 and 3).

Incidentally, when a glossy surface is formed on an image support using a clear toner, air bubbles are occasionally accumulated in the interior of the glossy surface, whereby cloudiness of the glossy surface due to air bubble generation and occurrence of non-uniformity have become the causes of the decrease of image quality of formed printed matter. It has been thought that air bubble accumulation occurs since air present among toner particles or between an image support and a clear toner layer cannot be moved in the nip portion during fixing and then compressed. Therefor, a technique has been investigated in which on a clear toner, a member enabling to move air is provided and thereby air having been accumulated in the nip portion during fixing is moved to the outside to avoid occurrence of air bubble accumulation (for example, refer to Patent Document 4). This technique has been one to transfer a clear toner layer onto a fixing belt, in which such a transferred clear toner layer is provided with linear grooves in the direction parallel to or diagonally backward to the conveyance direction of the image support and then air having been accumulated the nip portion is discharged via the grooves.

PRIOR ART DOCUMENTS

Patent Documents

Patent Document 1: Unexamined Japanese Patent Application Publication No. 11-7174

Patent Document 2: Unexamined Japanese Patent Application Publication No. 2007-140037

Patent Document 3: Unexamined Japanese Patent Application Publication No. 2002-341619

Patent Document 4: Unexamined Japanese Patent Application Publication No. 2003-316192

BRIEF DESCRIPTION OF THE INVENTION

Problems to be Solved by the Invention

However, the present inventors investigated the technique disclosed in Patent Document 4 and thereby, air bubble generation as visually noted on the glossy surface was not seen as described in the patent document but obscure clouds were observed in places. The present inventors observed these obscure clouds using a microscope and noticed that minute air bubbles having a diameter of far less than 100 μm existed and such minute air bubbles generated the clouds The reason why these air bubbles were generated was presumed as follows: while heated and melted, a clear toner layer having been transferred on the fixing belt was transferred onto the image support, whereby the grooves of the clear toner layer were eliminated or reduced due to melting and then air was insufficiently moved.

Further, it was noted that a glossy surface having been formed on the image support was stained and further when a glossy surface was continuously formed, a clear toner layer tended not to be transferred onto the fixing belt. The reason was thought as follows: a clear toner layer was directly transferred onto the fixing belt and the thus-transferred clear toner layer was heated and melted, whereby the clear toner remaining on the fixing belt caused stains and transfer failure.

In view of the above problems, the present invention was completed and an object thereof is to provide an image forming method in which when a glossy surface is formed using a clear toner, no air is allowed to remain in a clear toner layer and in the vicinity thereof during glossy surface formation so as not to generate minute air bubble accumulation in the glossy surface, and further, to provide an image forming method enabling to form a glossy surface exhibiting excellent transparency without obscure clouds due to the presence of minute air bubbles and non-uniformity due to the clouds.

Further, another object of the present invention is to provide an image forming method in which no residual clear toner is generated during formation of a glossy surface, and staining on the glossy surface due to the residual toner and transfer failure during clear toner layer formation are avoided.

Means to Solve the Problems

An image forming method comprising;

a step to form a clear toner layer on a photoreceptor, a step to transfer the clear toner layer having been formed on the photoreceptor onto a transfer member, a step to transfer the clear toner layer having been transferred on the transfer member onto an image support, a step to heat the image support on which the clear toner layer has been transferred, a step to bring the face on the side of the image support on which the clear toner layer has been transferred into close contact with a belt and to cool the image support on which the clear toner layer has been transferred in the state of being in close contact with the belt, and a step to separate the image support on which the clear toner layer has been transferred from the belt are provided, in this order, an image forming apparatus in which a clear toner layer is formed with a plurality of independent linear protrusion portions and wherein the independent linear protrusion portions are formed parallel or diagonally to the conveyance direction of an image support.

A plurality of linear protrusion portions are preferably arranged so as to penetrate from one end side of an image support toward the other end side.

The plurality of linear protrusion portions are preferably arranged so as to have a width of 100 μm to 300 μm and a distance of 50 μm to 150 μm.

When the clear toner feed amount during formation of a clear toner layer is designated as x and the width and the distance of protrusion portions constituting the clear toner layer are designated as W and D, respectively (μm), the clear toner feed amount x (g/m$^2$), and the width W and the distance D of the protrusion portions preferably satisfy the relationship of $0.0008D^2-0.12D+12 \geq x(D+W)/W \geq 0.0004D^2-0.06D+6$.

In an image forming apparatus having a clear toner layer forming device to transfer a clear toner layer onto an image support, a glossy surface forming device to form a glossy surface on the image support on which the clear toner layer has been transferred by the clear toner layer forming device, and a control device to control the operation of the glossy surface forming device, in which the clear toner layer forming device is provided with a photoreceptor, an exposure member to expose the photoreceptor, a clear toner feeding member to feed a clear toner to the photoreceptor on which a latent image has been formed by the exposure member, and a transfer member to transfer a clear toner layer having been formed on the photoreceptor by the clear toner feeding member onto an image support;

the glossy surface forming device is provided with a heating member to heat the image support on which the clear toner layer having been formed by the clear toner layer forming device, a belt member with which the image support is brought into close contact via the clear toner layer having been melted via heating by the heating member, a cooling member to cool the image support in the state of being in close contact with the belt member, and a separating member to separate the image support in which the clear toner layer has been solidified via cooling by the cooling member from the belt member; and the control device controls the operation of the clear toner layer forming device so that a clear toner layer formed on the photoreceptor has a plurality of independent linear protrusion portions and when the clear toner layer is transferred onto an image support, the plurality of independent linear protrusion portions are formed parallel or diagonally to the conveyance direction of the image support.

The control device preferably controls the operation of the clear toner layer forming device to carry out transfer onto an image support so that a plurality of linear protrusion portions constituting a clear toner layer having been transferred onto the image support penetrate from one end side of the image support toward the other end side.

The control device preferably controls the operation of the clear toner layer forming device so that a plurality of linear protrusion portions constituting a clear toner layer are formed with a width of 100 μm to 300 μm and a distance of 50 μm to 150 μm.

The control device preferably controls the operation of the clear toner layer forming device so that when the clear toner feed amount during formation of a clear toner layer is designated as x and the width and the distance of protrusion portions constituting the clear toner layer are designated as W and D, respectively, the clear toner feed amount x and the width W and the distance D of the protrusion portions satisfy the relationship of $0.0008D^2-0.12D+12 \geq x(D+W)/W \geq 0.0004D^2-0.06D+6$.

Effects of the Invention

In the present invention, it was found that a clear toner layer formed on an image support was formed with a plurality of linear protrusion portions and the protrusion portions were formed parallel or diagonally to the conveyance direction of the image support and thereby the above problems were solved. Namely, the present invention made it possible that when a glossy surface was formed on an image support by feeding a clear toner, occurrence of air bubble accumulation considered due to the influence of air within a clear toner layer was prevented and a well-finished glossy surface was formed without image failure such as cloudiness and non-uniformity resulting from air.

PREFERRED EMBODIMENT OF THE INVENTION

Figure 1A:
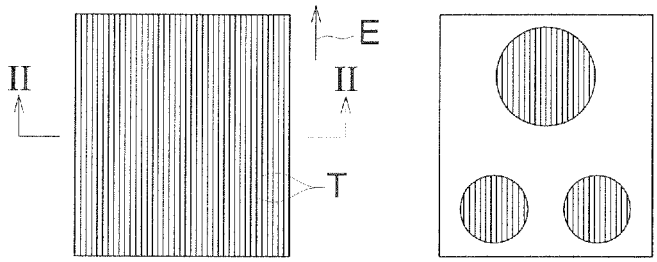
FIG. 1*a* through FIG. 1*e* include schematic views showing a formation pattern of a plurality of linear protrusion portions constituting a clear toner layer.

The present invention relates to an image forming method to form a glossy surface on an image support at least via steps to form a clear toner layer; to transfer the thus-formed clear toner layer onto an image support; and to heat and cool the image support on which the clear toner layer has been transferred. And, a clear toner layer formed in the present invention is formed with a plurality of independent linear protrusion portions, and the plurality of linear protrusion portions are formed parallel or diagonally to the conveyance direction of an image support when the clear toner layer is transferred onto the image support.

The present inventors focused attention on the cause of occurrence of air bubble accumulation via the technique of Patent Document 4 described above and then thought that if grooves were provided for a clear toner layer to allow air to escape, a configuration enabling to ensure an escape route of air even with heating and melting was required. Then, attention was focused on the fact that in Patent Document 4, even when grooves were provided on a clear toner layer, such grooves having been formed with effort were buried by heating and melting and thereby no escape route of air could be ensured.

Therefore, the present inventors thought of a method to feed a clear toner so that when a clear toner layer was formed, an escape route of air could be adequately ensured even when the clear toner layer was melted by heating and, after investigations, thought that a clear toner layer was not formed as a face but formed as very thin lines. Thereby, it was found out that using a clear toner, very thin line images were formed and then a clear toner layer was formed with an aggregate of these line images.

Further, the present inventors carried out heating after a clear toner layer had been transferred onto an image support so as for air bubble accumulation not to occur due to failure of escape of air, produced via transfer of the clear toner layer, existing between the image support and the clear toner layer. Then, attention was focused on the cross-sectional shape of a clear toner layer and it was thought that the state where air was easiest to move was a state in which no toner was allowed to be present in the moving area of air. And, it was thought that a clear toner layer was formed with a constitution in which an area with a toner and an area with no toner existed. Thereby, it was found out that when an area where no toner was present was provided, a glossy surface was able to be formed as air was efficiently and certainly discharged to the outside of the clear toner layer.

The present invention made it possible that the shape of a clear toner layer was specified in such a manner as described above and also when a clear toner layer having an independent cross-sectional shape in each protrusion portion was transferred onto an image support and the image support was heated and cooled, a glossy surface was formed without air bubble accumulation.

In the present invention, a clear toner layer is considered "a layer formed with a plurality of independent linear protrusion portions," which means that a clear toner layer is formed with an aggregate of a plurality of very thin clear toner line images. In other words, "very thin clear toner line images" are expressed by the term "protrusion portions." It is meant that the "very thin clear toner line images" are independent of each other with a distance between the line images to some extent and the shape is linearly formed.

Namely, in the present invention, an area where no clear toner is present in a clear toner layer is intentionally provided to allow air to easily move using this area during glossy surface formation. Further, as described in the results of EXAMPLES described later, even with respect to a clear toner image having a plurality of independent linear protrusion shapes, a formed glossy surface is well finished without generation of an area where no clear toner exists.

The present invention will now be detailed.

A "clear toner" referred to in the present invention refers to a toner particle which does not contain a colorant (for example, a coloring pigment, a coloring dye, black carbon particles, and black magnetic powder) exhibiting coloration via the action of light absorption or light scattering. Further, the clear toner referred to in the present invention is usually colorless and transparent, being practically colorless and transparent even though transparency is slightly decreased based on the type and added amount of a resin, a wax, and an external additive constituting the clear toner.

A "clear toner layer" referred to in the present invention refers to a clear toner area formed on a transfer member or an image support referred to in the present invention using the above-described clear toner. This "clear toner area" refers to both one left in the state prior to melting and curing of a clear toner and one in the state where the clear toner has been melted and cured. Especially, in the present invention, the case where a clear toner area is formed over the entire image support area is included.

The "clear toner area" forms a face, generally referred to as a "glossy surface," formed via melting and curing of the clear toner layer having been formed on an image support. The "clear toner layer" referred to in the present invention refers to one in the state of being formed on a transfer member or an image support and of being not yet melted by heating. The "glossy surface" refers to one in the state where a "clear toner layer" having been formed on an image support has been melted by heating, followed by being cooled and cured.

An "image" referred to in the present invention refers to one having a form as a medium to provide the user with information, for example, as is seen in a character image and a picture image. Namely, only an area where a toner or an ink exists on an image support is not meant but the constitution is made by containing also an area with no toner or ink generally referred to as a "white background," resulting in a form in which by combination of these areas, information is provided for the user. Further, the "image" referred to in the present invention contains both one having a clear toner layer and one having no clear toner layer. Still further, in the present invention, the forming method of an image covered with a clear toner is not specifically limited. A clear toner layer is formed on an image having been produced by an image forming method such as an electrophotographic system, a printing system, an ink-jet system, or a silver halide photographic system.

Initially, a clear toner layer formed in the present invention will be described. The clear toner layer is formed with a plurality of linear protrusion portions. The plurality of linear protrusion portions are formed parallel or diagonally to the conveyance direction of an image support.

In FIG. 1*a* through FIG. 1D, typical formation patterns of a plurality of linear protrusion portions T constituting a clear toner layer CT formed in the present invention. The arrow E in the figure shows the conveyance direction of an image support P.

Figure 1B:
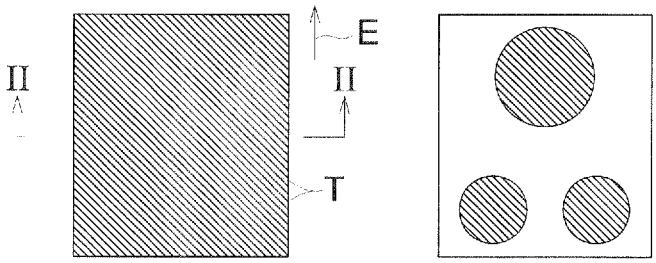
Figure 1C:
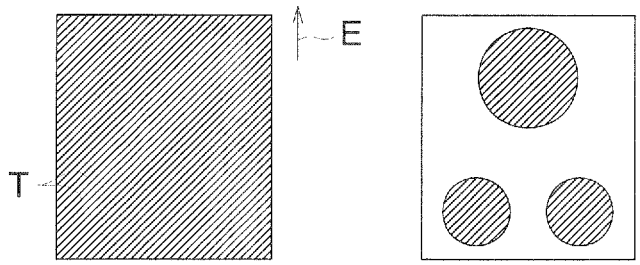

The formation pattern of "a plurality of linear protrusion portions T" shown in FIG. 1*a* is formed parallel to the conveyance direction E of an image support P when a clear toner layer CT has been transferred onto the image support P. The formation pattern of protrusion portions T shown in FIG. 1*b* is formed diagonally backward to the right with respect to the conveyance direction E of the image support P. The formation pattern of protrusion portions T shown in FIG. 1*c* is formed diagonally backward to the left with respect to the conveyance direction E of the image support P. Namely, in "a plurality of linear protrusion portions T" each shown in FIGS. 1*a* to 1*c*, one linear protrusion portion T is shaped so as not to bend, which corresponds to a pattern "arranged so as to penetrate from one end side of an image support toward the other end side."

Figure 1D:
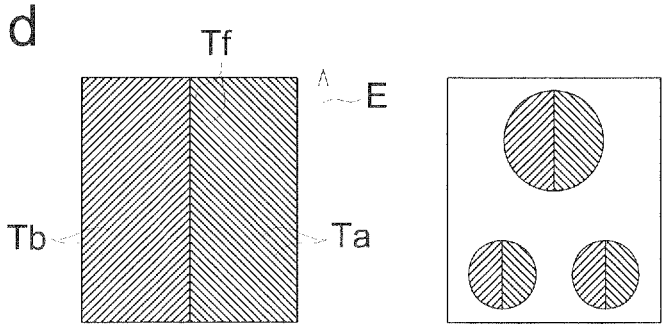

On the other hand, in the formation pattern of protrusion portions T shown in FIG. 1*d*, one linear protrusion portion T has a bending portion Tf nearly in the center of an image support P. This pattern does not correspond to one "arranged so as to penetrate from one end side of an image support toward the other end side." In other words, the formation pattern shown in FIG. 1*d* has 2 patterns which are a pattern of protrusion portions Ta and a pattern of protrusion portions Tb in which one linear protrusion portion T is formed, in the center of the bending portion Tf, diagonally backward to the right and diagonally backward to the left with respect to the conveyance direction E of an image support P, respectively.

A clear toner layer CT may be formed with an area corresponding to the size of an image support P so as to cover the entire image support P area or may be formed with an area smaller than that of the image support P so as to cover only a certain area in which an image on the image support P is formed.

A plurality of linear protrusion portions constituting a clear toner layer CT is preferably formed, for example, as shown in FIGS. 1A to 1C, so as to be arranged by linearly penetrating from one end side of an image support toward the other end side with no bending portion. Protrusion portions T are preferably arranged so as to penetrate from one end side of the image support toward the other end side, since open spaces formed between the protrusion portions are also formed so as to penetrate from one end side of the image support toward the other end side, resulting in a constitution in which air within the clear toner layer is easy to discharge to the outside of the image support.

A plurality of protrusion portions T constituting a clear toner layer CT are preferably completely linear but may be curved or bended gently along the way due to the restriction of formation accuracy of the clear toner layer, as long as a state approximating a straight line as a whole is realized. Namely, the term "linear" referred to in the present invention refers to "a state approximating a straight line as a whole even with a gentle curvature or bending."

Figure 1E:
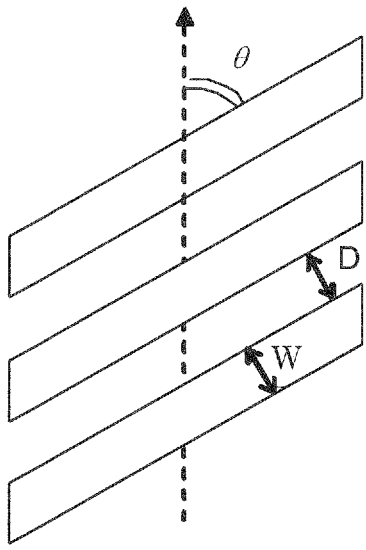

FIG. 1*e* is a schematic view showing an arrangement state of a plurality of linear protrusion portions T constituting a clear toner layer CT. The symbol θ in the figure is referred to as "a diagonally intersecting angle" which is the intersection angle between the formation direction of the protrusion portions T and the conveyance direction E of an image support P. In the present invention, a plurality of linear protrusion portions T constituting a clear toner layer CT are formed parallel or diagonally to the conveyance direction of an image support P, and specifically, the angle (the diagonally intersecting angle) θ with respect to the conveyance direction E of the image support P is preferably allowed to be 0° to 60°. Herein, it is meant that when the diagonally intersecting angle θ is 0°, linear protrusion portions T are formed parallel to the conveyance direction of the image support P. In FIG. 1*e*, protrusion portions constituting a clear tone layer CT are formed diagonally backward to the right with respect to the conveyance direction E of the image support P. Further, in FIG. 1*e*, the distance D of the protrusion portions T constituting the clear toner layer and the width W thereof are shown.

In the present invention, the width D of a plurality of linear protrusion portions T is preferably 100 μm to 300 μm. The width D of the protrusion portions T is allowed to be 100 μm to 300 μm, and thereby a clear toner is adequately fed to open spaces present between protrusion portions T constituting a clear toner layer CT when a glossy surface is formed. Thereby, a smooth and uniform glossy surface without irregularities can be formed. Namely, when the width W of the protrusion portions T is specified, a clear toner is spread over the entire area of a clear toner layer CT having been formed on an image support P, whereby the open spaces are thought to be also covered adequately without irregularities.

Further, the distance D of a plurality of linear protrusion portions T is preferably 50 μm to 150 μm. The distance D of the protrusion portions T is allowed to be 50 μm to 150 μm, and thereby air present in a clear toner layer is certainly removed when a glossy surface is formed. Thereby, a glossy surface having no air bubbles and exhibiting excellent transparency can be certainly formed. Namely, it is thought that a space to smoothly move air in a clear toner layer CT is ensured, and when a glossy surface is formed, air is certainly removed, resulting in the state where no air bubbles remain in the glossy surface. Further, it is thought that when the distance D of the protrusion portions T is allowed to be 50 μm to 150 μm, an adequate amount of a clear toner is fed from an adjacent protrusion portion, which also contributes to formation of a smooth glossy surface without irregularities.

Figure 2A:
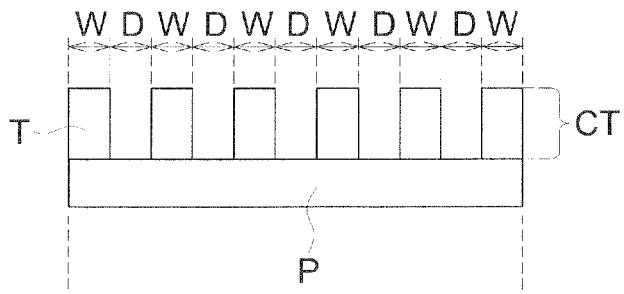
FIG. 2*a* through FIG. 2*d* include schematic views showing the cross-section of a clear toner layer when viewed from the direction at right angles to the conveyance direction of an image support.
Figure 2B:
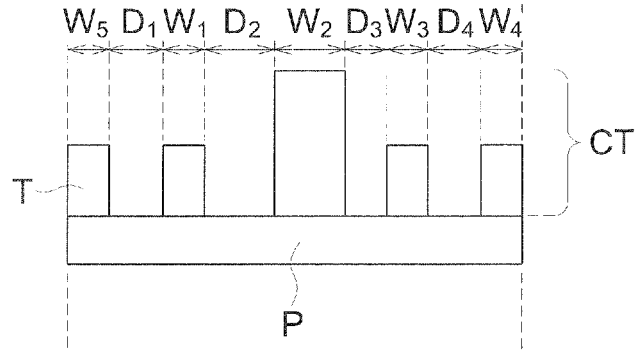

The distance D of a plurality of linear protrusion portions T constituting a clear toner layer CT is preferably arranged regularly with a constant distance, for example, as in the screen pattern shown in FIGS. 2A to 2D. However, the distance can also be formed at random if appropriate. FIGS. 2A to 2D each show a cross-section of a clear toner layer CT arranged in the II-II line direction shown in FIG. 1*a* or 1*b*, namely, in the direction at right angles to the conveyance direction of an image support P. FIG. 2*a* shows a clear toner layer CT in which a clear toner is uniformly fed on an image support P to arrange a plurality of protrusion portions T nearly at regular intervals. In FIG. 2*a*, the distance of the protrusion portions T is designated as D and the width of the protrusion portions T is designated as W. Further, FIG. 2*b* shows a clear toner layer CT in which a clear toner is fed to an image support P at random to allow both the distance D and the height H of the protrusion portions T to be irregular. In FIG. 2*b*, the differences in distance D of the protrusion portions T constituting a clear toner layer CT are represented by D1, D2, D3, and D4, and the differences in width W of the protrusion portions T are represented by W1, W2, and the like.

Figure 2C:
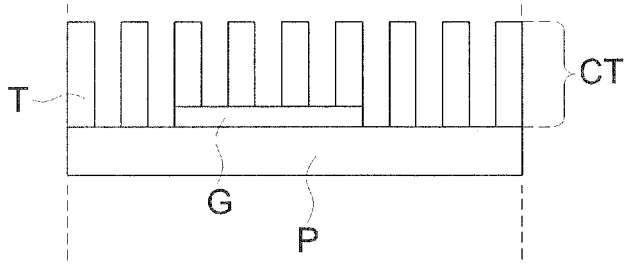
Figure 2D:
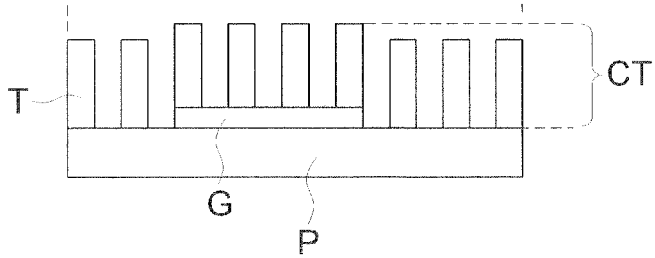

FIG. 2*c* is the case where a clear toner is fed on an image support P on which an image has been formed, showing a cross-section in the case where a relatively small amount of a clear toner is fed to an area on which an image G has been formed and a relatively large amount of the clear toner is fed to a white background area having no image. In FIG. 2*c*, when the feed amounts of a clear toner for an image area and a white background area are changed, a smoothly finished glossy surface without irregularities can be formed. Further, FIG. 2*d* is the case where a clear toner is fed on an image support P on which an image has been formed, showing a cross-section in the case where the same amount of a clear toner is fed to an area on which an image G has been formed and to a white background area.

In the present invention, it is more preferable to specify the width W and the distance D of protrusion portions T in the above range and in addition, to specify the feed amount of a clear toner. The present inventors found that when the width W and distance D of protrusion portions T in formation of a clear toner layer CT fell within in the above ranges, the feed amount of a clear toner was able to be specified to enable to certainly and uniformly fill the open spaces between the protrusion portions T with a clear toner and simultaneously, to ensure the movement of air.

When the clear toner feed amount during formation of a clear toner image CT is designated as $\times g/m^2$, filling of the open spaces of protrusion portions T and movement of air can be smoothly carried out if the distance D μm of the protrusion portions T and the line width W μm of a clear toner satisfy the following relational expression. Namely, when the relationship of $0.0008D^2-0.12D+12 \geq x(W+D)/W \geq 0.0004D^2-0.06D+6$ is satisfied, the open spaces between the protrusion portions T are uniformly filled and air in the clear toner layer can be certainly removed. It is shown that when the distance of the protrusion portions T increases, to completely fill the open spaces, the adhesion amount of a clear toner needs to increase; and when the distance of the protrusion portion clear toner images decreases, in the case of an excessive amount of the clear toner, air cannot escape. When the line width W and the distance D are not uniform, the average values thereof each are employed. The symbol x represents the toner adhesion amount per unit area, preferably satisfying the relationship of $3 \leq x \leq 15$ ($g/m^2$), and it is preferable that D satisfy the relationship of $50 \leq D \leq 150$ (μm) and W satisfy the relationship of $100 \leq W \leq 300$ (μm).

Clear toner feed amount can be controlled by any appropriate well-known method. As a specific method, for example, a method in which the surface potential of a photoreceptor, i.e., the development bias, is changed to control the clear toner feed amount is cited. In other words, the development bias in the photoreceptor surface is set relatively high and thereby the clear toner adhesion amount to the photoreceptor surface can be reduced. In contrast, the development bias is set relatively low and thereby the clear toner adhesion amount to the photoreceptor surface can be increased.

Figure 3:
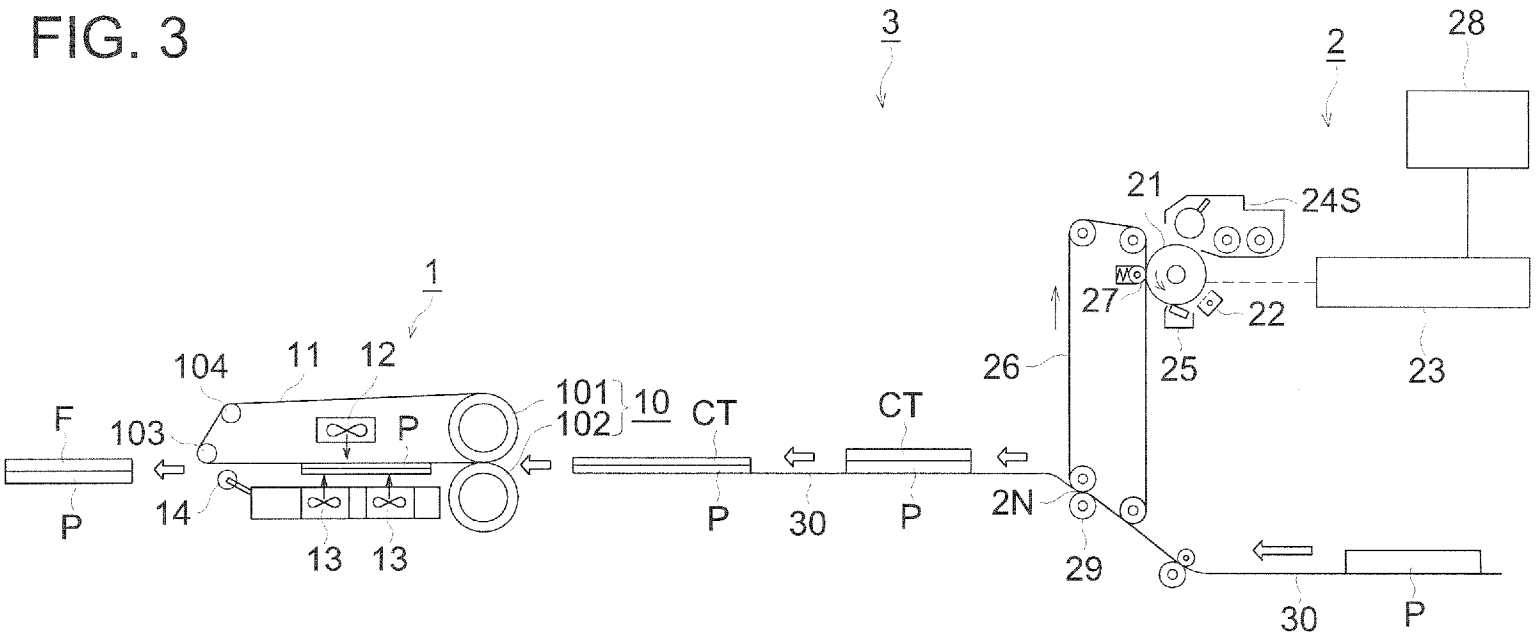
FIG. 3 is a schematic view of an image forming apparatus having a clear toner layer forming device to transfer a clear toner layer onto an image support and a glossy surface forming device to form a glossy surface on the image support on which the clear toner layer has been transferred.

An image forming apparatus, in which a clear toner layer shown in FIG. 1 and FIG. 2 is formed on an image support and then the clear toner layer is heated and cooled to form a glossy surface on the image support, will now be described. FIG. 3 is a schematic view of an image forming apparatus in which the image forming method according to the present invention can be performed. The image forming apparatus of FIG. 3 has a clear toner layer forming device 2 to form a clear toner layer formed with a plurality of independent linear protrusion portions on an image support and a glossy surface forming device 1 to form a glossy surface on an image support by heating and cooling the image support having a clear toner layer. Then, the clear toner layer forming device 2 has a control device (a computer) 28 to control clear toner layer formation on an image support. Namely, the image forming apparatus 3 shown in FIG. 3 is equivalent to an image forming apparatus, referred to in the present invention, having at least a clear toner layer forming device to transfer a clear toner layer onto an image support, a glossy surface forming device to form a glossy surface on the image support on which the clear toner layer has been transferred by the clear toner layer forming device, and a control device to control at least the operation of the glossy surface forming device.

The clear toner layer forming device 2 and the glossy surface forming device 1 constituting the image forming apparatus 3 shown in FIG. 3 will now be described.

Figure 4:
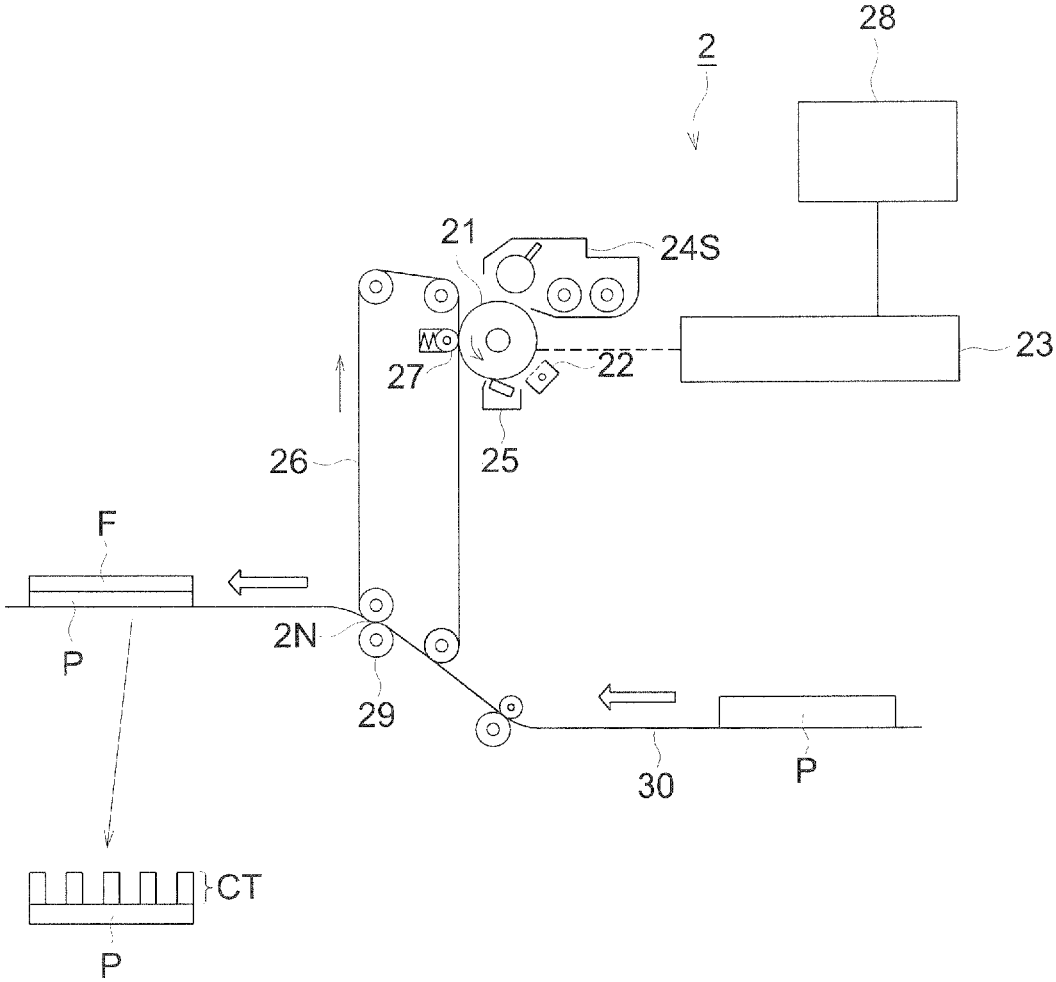
FIG. 4 is a schematic view of a clear toner layer forming device to form a clear toner layer on a transfer member and to transfer the formed clear toner layer onto an image support.

The clear toner layer forming device to form a clear tone layer described above on an image support is described. FIG. 4 is a schematic view of the clear toner layer forming device enabling to form a clear toner layer formed with a plurality of linear protrusion portions having the configuration shown in FIG. 1 and FIG. 2. The clear toner layer forming device 2 of FIG. 4 forms a clear toner layer on a photoreceptor, transfers the clear toner layer onto a transfer member, and transfers the clear toner layer having been transferred on the transfer member onto an image support. The clear toner layer forming device 2 of FIG. 4 has a photoreceptor drum 21 rotating in the arrow direction, a charging section 22 arranged in the periphery of the photoreceptor drum 21, a latent image writing section 23, a clear toner feeding section 24S, and a clear toner layer carrier 26.

The clear toner layer forming device 2 shown in FIG. 4 is a clear tone layer forming device having at least a photoreceptor, an exposure member to expose the photoreceptor, a clear toner feeding member to feed a clear toner to the photoreceptor on which a latent image has been formed by the exposure member, and a transfer member to transfer a clear toner layer having been formed on the photoreceptor by the clear toner feeding member onto an image support. In the clear toner layer forming device 2 shown in FIG. 4, "a step to form a clear toner layer on a photoreceptor, a step to transfer the clear tone layer having been formed on the photoreceptor onto a transfer member, and a step to transfer the clear toner layer having been transferred on the transfer member onto an image support" constituting the image forming method according to the present invention are carried out.

The constitution of the clear toner layer forming device 2 shown in FIG. 4 will now be described. The latent image writing section 23 corresponds to an exposure member referred to in the present invention, having an exposure section to form exposure light irradiated on the photoreceptor drum 21 and optical lens components to irradiate the exposure light onto the photoreceptor drum 21 as beam light. The exposure section is formed with a so-called LED array in which, for example, a plurality of light emitting diode elements (LEDs) are aligned in the shaft direction of the photoreceptor drum 21. The optical lens components are arranged so as to irradiate light from each light emitting diode element constituting the LED array onto the photoreceptor drum 21 as beam light. Irradiation by the latent image writing section 23 makes it possible to form, on the photoreceptor drum 21, an electrostatic latent image corresponding to a plurality of protrusion portions having, for example, one of the pattern shapes shown in FIG. 1.

In the clear toner layer forming device 2 of FIG. 4, "electrostatic latent image pattern data of a clear toner layer formed with a plurality of independent linear protrusion portions" specified in the present invention is previously stored in the storage section of the image processing device 28 operating as a control device represented by a computer.

An electrostatic latent image to form a clear toner layer can be shaped into a minute linear protrusion portion, for example, using a semiconductor laser generated by a light emitting diode element as an exposure light source. Over recent years, with the advance of digital technology, for example, in a latent image writing device employing a light emitting diode, a minute electrostatic latent image of an image writing density of 1200 dpi (dpi: dots per inch (2.54 cm)) can be written on the photoreceptor drum 21. Further, as the wavelength of the exposure light source is decreased, the width of exposure light can be decreased and then an electrostatic latent image used for protrusion portions having narrow width can also be formed on the photoreceptor drum 21 at high density. Specifically, using a light emitting diode element to irradiate short-wavelength semiconductor laser beams of an oscillation wavelength of 350 to 500 nm such as blue laser beams, an electrostatic latent image for a clear toner layer having a constitution in which protrusion portions having narrow width are arranged at high density can be formed.

The clear toner feeding section 24S corresponds to a clear toner feeding member and feeds a clear toner onto the photoreceptor drum 21 on which an electrostatic latent image has been formed to form a clear toner layer CT on the photoreceptor drum 21. The clear toner feeding section 24S includes a two-component developing device employing a two-component developer containing, for example, a colorless clear toner and a carrier and a single-component developing device of a non-contact type employing a single-component developer containing only a clear toner.

With regard to formation of a clear toner layer CT by the clear toner layer forming device 2, the photosensitive layer surface of the photoreceptor drum 21 rotating in the arrow direction is uniformly charged at a predetermined potential by the charging section 22, and thereafter on this surface, an electrostatic latent image to form a clear toner layer is formed by the latent image writing section 23. Subsequently, the electrostatic latent image is developed in the clear toner feeding section 24S to form a clear toner layer CT containing a clear toner on the photoreceptor drum 21. As shown in FIG. 1, this clear toner layer CT is formed with a plurality of linear protrusion portions T, and the cross-sectional shape thereof is as shown in FIG. 2.

The clear toner layer CT having been formed on the photoreceptor drum 21 is electrostatically transferred onto an endless-belt clear toner layer carrier 26 by the transfer section 27 corresponding to a transfer member. The clear toner layer CT having been transferred on the clear toner layer carrier 26 is conveyed, with rotation of the clear toner layer carrier 26, to a nip section 2N in which a secondary transfer roller 29 is arranged. In the nip section 2N in which the secondary transfer roller 29 is arranged, the clear toner layer CT on the clear toner layer carrier 26 is electrostatically transferred onto an image support P conveyed in the outlined arrow direction in the figure by a conveyance member 30.

In this manner, a clear toner layer CT is formed on an image support P having been processed by the clear toner layer forming device 2. FIG. 3 shows, in an image support P on which a clear toner layer CT has been formed, the cross-sectional structure of the clear toner layer CT when viewed from the direction at right angles to the conveyance direction of the image support P. The image support P on which a clear toner layer CT having been formed by the clear toner layer forming device 2 shown in FIG. 3 has been transferred is conveyed by the conveyance member 30 to the subsequent glossy surface forming device 1 shown in FIG. 5*a*.

Formation of a clear toner layer by the clear toner layer forming device 2 shown in FIG. 4 is controlled, as described above, by the operation of the image processing device 28 constituting the clear toner layer forming device 2. The image processing device 28 in FIG. 4 controls the exposure of the latent image writing section 23 so as to form an electrostatic latent image of a clear toner layer formed with a plurality of independent linear protrusion portions on the photoreceptor drum 21. As described above, on the photoreceptor drum 21, an electrostatic latent image is formed via exposure by the latent image writing section 23 so as to form a plurality of independent linear protrusion portions constituting a clear toner layer parallel or diagonally to the conveyance direction of an image support when the clear toner layer is formed and then transferred onto the image support.

In this manner, the image processing device 28 controls the operation of the clear toner layer forming device in such a manner that a clear toner layer formed on a photoreceptor has a plurality of independent linear protrusion portions and when the clear toner layer is transferred onto an image support, the plurality of independent linear protrusion portions are formed parallel or diagonally to the conveyance direction of the image support. In the clear toner layer forming device 2 of FIG. 4, "electrostatic latent image pattern data of a clear toner layer formed with a plurality of independent linear protrusion portions" is previously stored in the storage section of the image processing device 28 operating as a control device represented by a computer.

In this manner, in the glossy surface forming device of FIG. 3, electrostatic latent image pattern data of a clear toner layer is previously stored in the storage section of the image processing device 28 to control the operation of the glossy surface forming device. Then, during formation of a glossy surface, to form a latent image of a desired pattern, the image processing device 28 selects a corresponding pattern from the storage section. Further, the image processing section 28 controls exposure to the photoreceptor drum of the latent image writing section to form a latent image of a selected pattern. In this manner, on the photoreceptor drum 21, an electrostatic latent image of "a clear toner layer formed with a plurality of independent linear protrusion portions" is formed and then a clear toner layer having a shape as shown in FIG. 2 is formed.

Figure 5A:
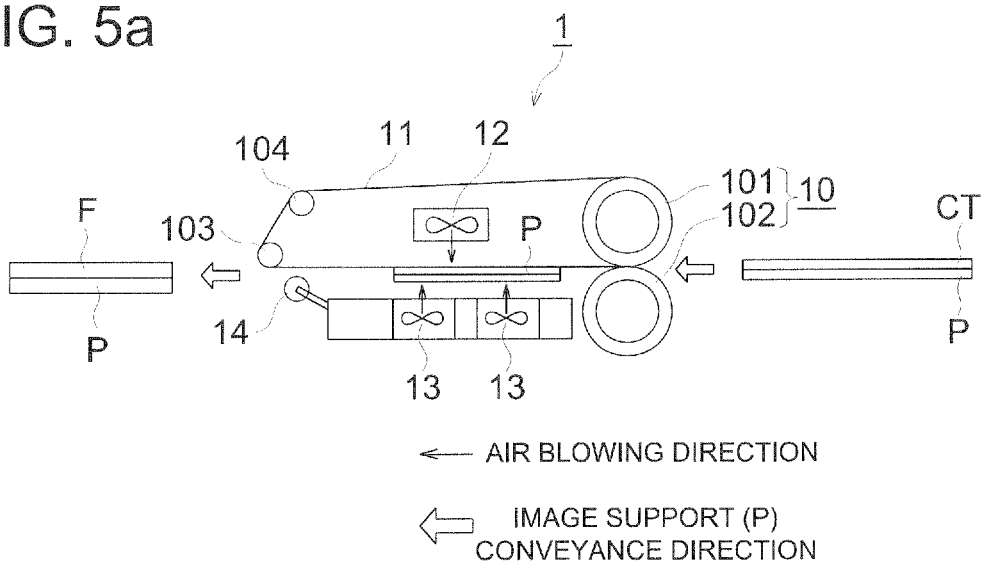
FIG. 5*a* and FIG. 5*b* are a schematic view of a glossy surface forming device to heat an image support on which a clear toner layer has been transferred, to melt a fed clear toner, and to cool the image support having a melted clear toner layer.
Figure 5B:
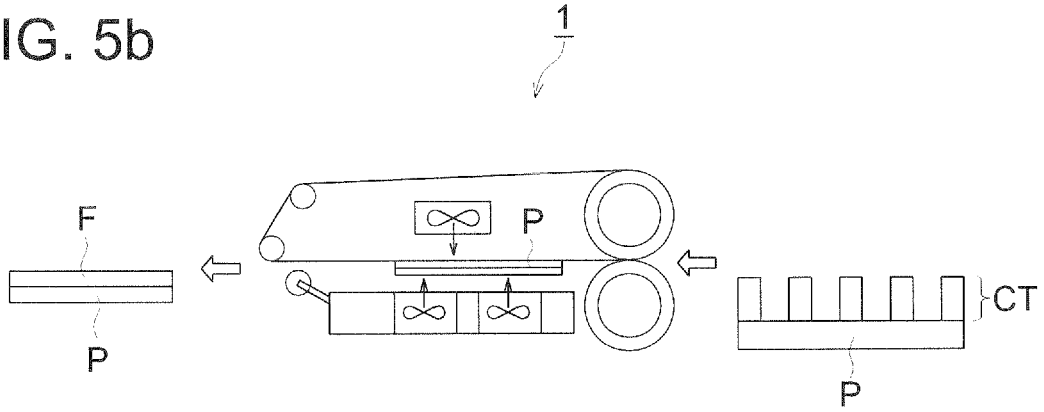

A glossy surface forming device to form a glossy surface on an image support on which a clear toner layer has been formed will now be described. Each of FIG. 5*a* and FIG. 5*b* is a schematic view of a glossy surface forming device to heat and melt a clear toner layer CT having been formed on an image support P and to cool the thus-melted clear toner layer CT to form a glossy surface F on the image support P. The glossy surface forming device 1 shown in FIG. 5*a* can form a glossy surface F over the entire image support area with respect to an image support P fed in the state where a clear toner layer CT has been formed over the entire area. Further, FIG. 5*b* shows, on the right side of the glossy surface forming device 1, a cross-sectional structure of an image support P on which a clear toner layer CT has been formed when viewed from the direction perpendicular to the conveyance direction of the image support P, and shows a cross-sectional structure of an image support P on which a glossy surface F has been formed on the left side of the device 1. Namely, FIG. 5*b* shows that a clear toner layer CT formed with a plurality of linear protrusion portions having been formed on an image support P results in a glossy surface F via processing in the glossy surface forming device 1.

The glossy surface forming device 1 shown in FIG. 5*a* and FIG. 5*b* has at least the following constitution:

(1) a heating and pressing device 10 to heat and simultaneously press an image support P in the state where over the entire image support area, a clear toner has been fed in a layered manner, (2) a belt member 11 to make contact with the clear toner surface having been melted by the heating and pressing device 10 and to form an adhesion surface between the clear surface and itself to convey the image support P, (3) cooling fans 12 and 13 to supply cooling air to the image support P which is being conveyed in the state of adhering to the belt member 11, and (4) a conveyance roll 14 to convey the image support having been cooled by the action of air supplied from the cooling fans 12 and 13 in which the clear toner surface has been solidified.

The glossy surface forming device 1 has a heating member to heat an image support on which a clear toner layer having been formed by the clear toner layer forming device has been transferred, a belt member to bring the image support into close contact via the clear toner layer having been melted via heating by the heating member, and a separating member to peel, from the belt member, the image support in which the clear toner layer has been solidified via cooling by the cooling member. Then, the glossy surface forming device 1 performs "a step to heat an image support on which a clear toner layer has been transferred, a step to bring the face on the side of the image support on which the clear toner layer has been transferred into close contact with a belt and to cool the image support on which the clear toner layer has been transferred in the state of being in close contact with the belt, and a step to separate the image support on which the clear toner layer has been transferred from the belt" constituting the image forming method according to the present invention.

The heating and pressing device 10 will now be described. As shown in FIG. 5*a*, the heating and pressing device 10 nips an image support, on which a clear toner layer CT has been formed, between a pair of rolls 101 and 102 driven at a constant rate for conveyance to heat and press the thus-conveyed image support P. A clear toner having been fed over the entire area of the image support P is melted via heating by the heating and pressing device 10 and also the thus-melted clear toner results in a layer having uniform thickness by pressurization. Herein, the center of each of the paired rolls 101 and 102 is provided with a heating source and thereby heating can be carried out to melt a clear toner having been fed over the entire image support area. Further, the 2 rolls 101 and 102 are preferably structured so as to be in pressure contact with each other to certainly press a clear toner melted between the rolls.

The glossy surface forming device 1 can adequately carry out heating and pressing when a constitution is employed in which, for example, the roll 101 constituting the heating and pressing device 101 is allowed to serve as a heating roll and the roll 102 is allowed to serve as a pressing roll, from the viewpoint of power consumption and operation efficiency. On the surface of either or both of the rolls 101 and 102, a silicone rubber layer or a fluorine rubber layer can be arranged. The width of the nip region for heating and pressing is preferably allowed to fall within the range of about 1 mm to 12 mm.

The heating roll 101 is formed with a predetermined outer diameter in which, for example, the surface of a metal base body such as aluminum is covered with an elastic body layer formed of silicone rubber. Inside the heating roll 101, for example, a halogen lamp of 300 to 350 W is arranged as a heating source and then heating is carried out from the interior so that the surface temperature of the heating roll 101 reaches a predetermined temperature.

The pressing roll 102 is formed with a predetermined outer diameter in which, for example, the surface of a metal base body such as aluminum is covered with an elastic body layer formed of silicone rubber and further the elastic body layer surface is covered with a surface layer formed as a tube made of PFA (tetrafluoroethylene.perfluoroallcyl vinyl ether copolymer). Also, inside the pressing roll 102, for example, a halogen lamp of 300 to 350 W can be arranged as a heating source and heating is carried out from the interior so that the surface temperature of the pressing roll 102 reaches a predetermined temperature.

An image support P in which a clear toner has been fed over the entire image forming area is conveyed to the pressure contact section (the nip section) formed by the heating roll 101 and the pressing roll 102 of the heating and pressing device 10. At this moment, conveyance is carried out so that the face where the clear toner has been fed is placed on the heating roll 101 side. While passed through the pressure contact section formed by the heating roll 101 and the pressing roll 102, the clear toner is heated and melted, and simultaneously fused on the image face as a clear toner layer.

The belt member 11 will now be described. The belt member 11 is an endless belt rotatably supported by a heating roll 101 and a plurality of rolls 101, 103, and 104 including the heating roll 101. As described above, the belt member 11 is rotatably suspended and stretched by a plurality of rolls containing a heating roll 101, a separating roll 103, and a driven roll 104 and driven by the heating roll 101 rotatably driven by an unshown drive source at a predetermined moving velocity. Then, a rotational drive can be carried out with no wrinkles at a predetermined process rate via the drive of the heating roll 101 and the tension of the separating roll 103 and the driven roll 104.

The belt member 11 makes close contact with an image support P via the melted clear toner surface and conveys the image support P via the contact surface with the clear toner. In this manner, the belt member 11 is brought into close contact with a heated and melted clear toner surface, and may be therefor produced using a material exhibiting heat resistance and mechanical strength to some extent. Specifically, there are listed, for example, heat resistant film resins such as polyimide, polyether polyimide, PES (polyether sulfone resins), or PFA (tetrafluoroethylene.perfluoroalkyl vinyl ether copolymer resins). And, at least on the side of the contact face of a heat resistant film resin with a clear toner layer, a surface layer of a fluorine resin such as PTFE (polytetrafluoroethylene) or PFA or silicone rubber is preferably provided.

Figure 6:
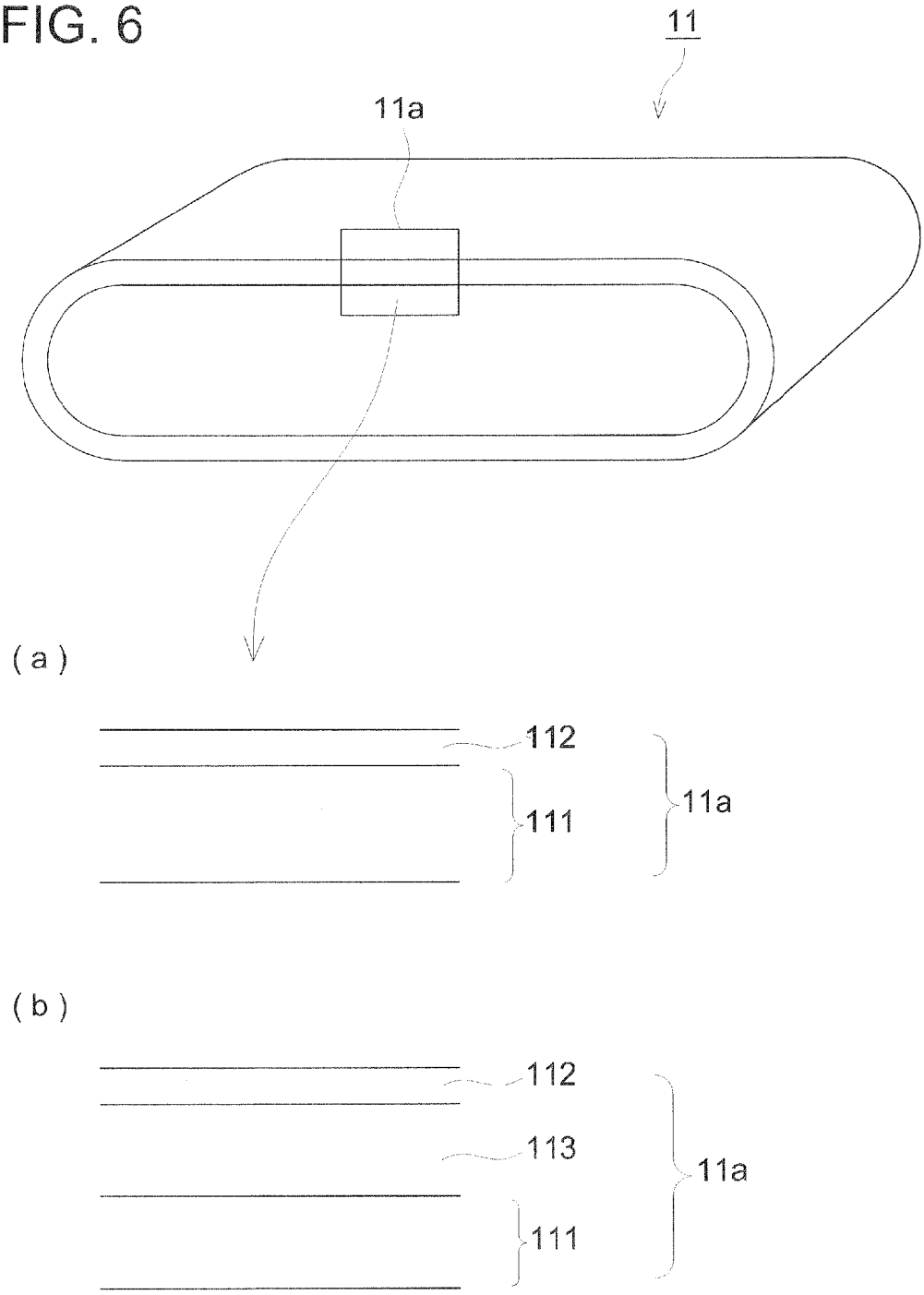
FIG. 6 is a schematic view showing one example of the constitution of a belt member for a glossy surface forming device.

One example of the structure of a belt member 11 in which on a base body 111 mountable on the glossy surface forming device 1 of FIG. 5, a surface layer 112 is provided is schematically shown in FIG. 6(*a*). In the belt member 11 shown in FIG. 6A, the structure of its cross-sectional portion 11*a* is a structure in which on a base body 111, a surface layer 112 is directly provided. In one shown in FIG. 6(*b*), on a base body 111, an elastic layer 113 is provided and thereon, a surface layer 112 is provided.

The thickness of the belt member 11 is not specifically limited, as long as via the adhesion surface to a melted clear toner layer, an image support is conveyed, and any appropriate thickness is employable. Specifically, the thickness of a heat resistant film resin is preferably 20 μm to 80 μm, and the thickness of the surface layer is preferably 1 μm to 30 μm. The thickness of the entire belt member is preferably about 20 μm to 110 μm. As a specific configuration, there in one in which, for example, on a polyimide endless film of a thickness of 80 μm, a silicone rubber layer of a thickness of 30 μm is covered.

The cooling fans 12 and 13 will now be described. The glossy surface forming device 1 shown in FIG. 5*a* has a cooling fan 12 between the heating roll 101 and the separating roll 103 on the inner face side of the belt member 11 and a cooling fan 13 between the pressing roll 101 and the conveyance roll 14 on the outer face side of the belt member 11.

Herein, the outer face of the belt member 11 refers to a face to support and convey an image support P in the state of adhering to the image support P via the melted clear toner surface to form an adhesion surface.

In the glossy surface forming device 1 of FIG. 5, via a clear toner layer being melted with a predetermined thickness by the heating and pressing device 10, an image support P is brought into close contact with the outer face of the belt member 11, and in this state, the image support P is conveyed and simultaneously the clear toner layer is forcedly cooled to be cured. The cooling fans 12 and 13 supply air to the image support P which is being conveyed in the state of making close contact with the belt member 11 via the clear toner layer to cool the image support P which is being conveyed. In the glossy surface forming device 1, a cooling heatsink or heat pipe can be arranged via communicative communication to each of the cooling fans 12 and 13. Such a cooling heatsink or heat pipe can accelerate cooling and curing of a melted clear toner layer.

Forced cooling by the cooling fans 12 and 13 accelerates curing of a clear toner layer of an image support P which is being conveyed by the belt member 11. Then, the clear toner layer on the image support P has been cooled and cured when the image support P reaches the vicinity of the belt end portion in which the conveyance auxiliary roll 14 and the separating roll 103 are arranged. Then, the image support P is peeled from the belt member 11 surface at the belt end portion.

The image support P having been conveyed to the vicinity of the belt end portion where the conveyance direction of the belt member 11 is changed is still in close contact with the belt member 11 via the clear toner layer. In this state, the conveyance auxiliary roll 14 makes contact with the rear face of the image support P which is being conveyed for holding. In the state where the conveyance auxiliary roll 14 holds the image support P from its rear face, the belt member 11 reaches the location where the separating roll 103 is arranged and at this location, the conveyance direction of the belt member 11 is changed to the direction of the driven roll 104 side (upward in the figure). At this moment, the image support P is peeled from the belt member 11 by its own stiffness. Then, via the shift of gravity to the auxiliary roll 14, separating from the belt member is accelerated, and separation and discharging from the glossy surface forming device 1 are carried out. In this manner, the auxiliary roll 14 and the separating roll 103 arranged in the vicinity of the belt end portion corresponds to a separating member.

Via the above procedures, the glossy surface forming device 1 shown in FIG. 5 forms an even and uniform gloss surface F on an image support on which a clear toner layer has been transferred. Namely, the procedures include the following steps.

(1) An image support on which a clear toner layer has been transferred is heated to melt the clear toner layer.

(2) Via a melted clear toner layer, the image support P is brought into close contact with the belt member 14 and in this state, as the image support is conveyed, the clear toner layer is cooled and cured.

(3) When the clear toner layer has been sufficiently cured, the image support P is peeled from the belt member 11.

(4) The image support P having been peeled from the belt member 11 is discharged to the outside of the glossy surface forming device.

In the glossy surface forming device 1 shown in FIG. 5, by the conveyance auxiliary roll 14 and the separating roll 103, an image support P is peeled from the belt member 11. However, a separating member other than the separating roll 103 is employable. It is possible that instead of the separating roll 103, for example, a separating nail is arranged between the belt member 11 and the image support P and thereby the image support P is peeled from the belt member 11.

The clear toner layer forming device 2 shown in FIG. 4 and the glossy surface forming device 1 shown in FIG. 5 can be used by connecting to an image forming apparatus such as a printer or a printing apparatus. On an image support on which an image has been formed using an image forming apparatus such as a printer, a clear toner layer is transferred using the clear toner layer forming device shown in FIG. 4 and subsequently, using the glossy surface forming device shown in FIG. 5, a fed clear toner layer is heated and cooled to form a glossy surface. In this manner, on an image having been formed using an image forming method such as, e.g., an electrophotographic system, a printing system, an ink-jet system, or a silver halide photographic system, a clear toner layer is formed, followed by heating and melting, whereby a glossy surface can be formed.

Figure 7:
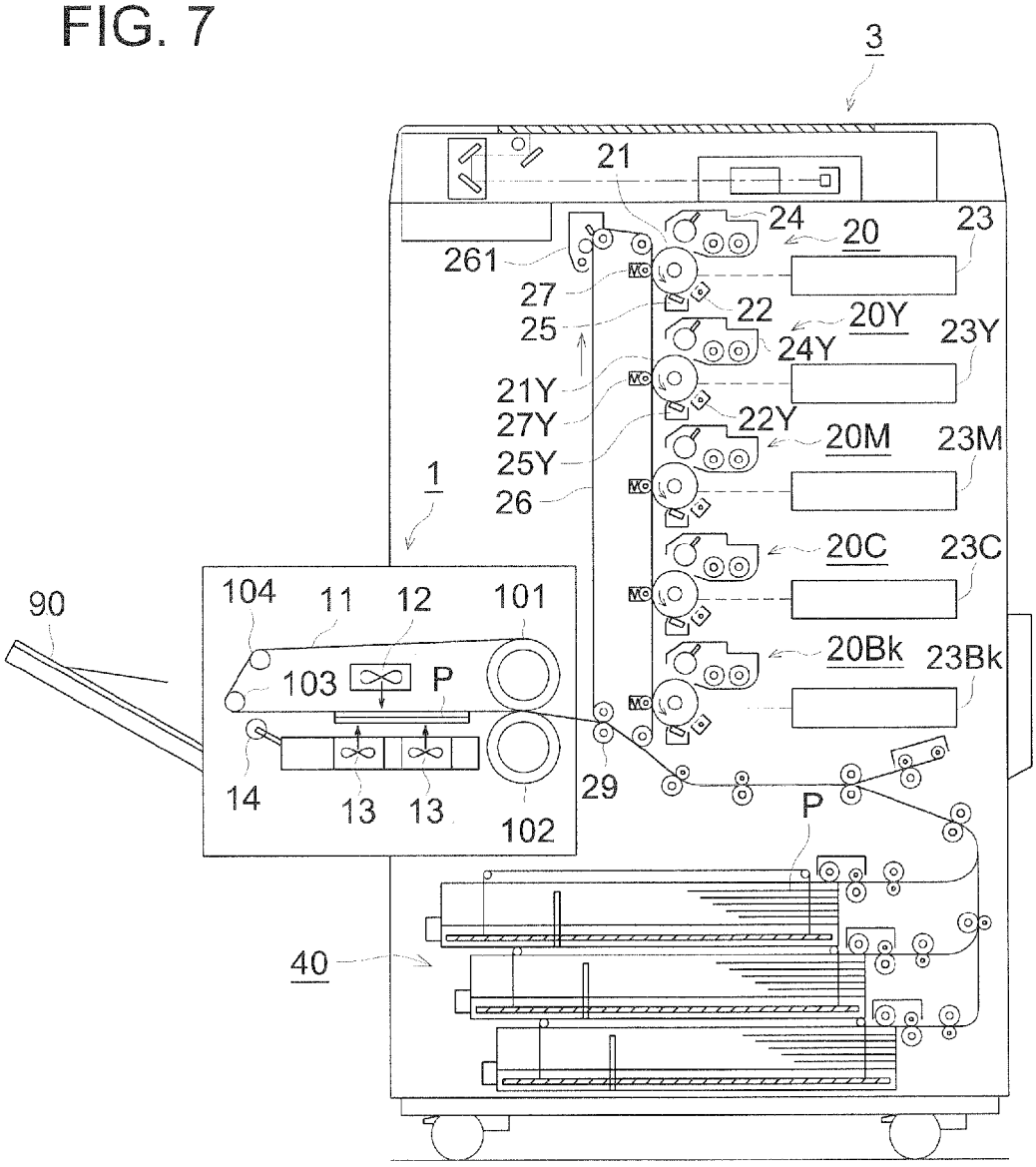
FIG. 7 is a cross-section constitutional view of an image forming apparatus in which glossy surface formation and full-color image formation are simultaneously carried out.

FIG. 7 is a cross-section constitutional view of an electrophotographic image forming apparatus enabling to carry out full-color image formation via an electrophotographic system and also to form a clear toner layer on a formed full-color toner image to further form a glossy surface. The image forming apparatus 3 shown in FIG. 7 is mounted with the glossy surface forming device 1 shown in FIG. 5, in which in the same manner as in the glossy surface forming device 1 of FIG. 5, a glossy surface F is formed from a clear toner layer and in addition, a toner image having been formed on an image support is fixed.

The image forming apparatus 3 show in FIG. 7 is commonly referred to also as "a tandem-type color image forming apparatus," incorporating a clear toner layer forming section 20, a plural sets of tone image forming sections 20Y, 20M, 20C, and 20Bk, a belt-shaped intermediate transfer belt 26, and a sheet feeding device 40, as well as the glossy surface forming device 1 shown in FIG. 5.

In the image forming apparatus 3 of FIG. 7, the collective designation of constituent elements is represented by a reference symbol with no alphabetical suffix and an individual constituent element is represented by a reference symbol with a suffix such as S (clear toner), Y (yellow), M (magenta), C (cyan), or Bk (black).

The clear toner layer forming device 20, and each of the toner image forming sections 20Y, 20M, 20C, and 20Bk of the image forming apparatus 3 are provided with an image reading section 23. For example, when an original document having been placed on the document platen is read to form an image of the original document, controlling is carried out by an image processing device, not shown, so that an image is scanned and exposed by the optical system of the document image scanning and exposing device of the image reading section to be read in a line image sensor. An analog signal having been photoelectrically converted by the line image sensor is subjected to analog processing, A/D conversion, shading correction, and image compression processing by the image processing device to be thereafter input to the image writing sections 23Y, 23M, 23C, and 23Bk for toner image formation.

The image forming apparatus shown in FIG. 7 is provided with, other than a clear toner layer forming device 20 to form a clear toner layer on an image support using a clear toner, a yellow image forming section 20Y to form a yellow toner image, a magenta image forming section 20M to form a magenta toner image, a cyan image forming section 20C to form a cyan toner image, and a black image forming section 20Bk to form a black toner image. Each image forming section has a photoreceptor drum 21, 21Y, 21M, 21C, or 21Bk serving as an image carrier. In the periphery thereof, a charging electrodes 22, 22Y, 22M, 22C, and 22Bk; image writing sections 23, 23Y, 23M, 23C, and 23Bk; a clear toner feeding device 24 and developing devices 24Y, 24M, 24C, and 24Bk; and cleaning devices 25, 25Y, 25M, 25M, 25C, and 25Bk are each provided.

The photoreceptor drum 21 is formed of an organic photoreceptor in which a photosensitive layer made of a resin containing an organic photoconductor is formed on the outer circumferential surface of a drum-shaped metal base body, being arranged so as to extend in the width direction of a transfer medium P conveyed (in the direction vertical to the paper plane in FIG. 7). As a resin constituting the photosensitive layer, a photosensitive layer forming resin such as, e.g., a polycarbonate resin is used. In the configuration shown in FIG. 7, a constitutional example employing a drum-shaped photoreceptor is illustrated, which is not limited but a belt-shaped photoreceptor can be used.

The clear toner feeding section 24S and the developing sections 24Y to 24Bk incorporate a two-component developer containing a clear toner used in the present invention or a toner of different color of a yellow toner (Y), a magenta toner (M), a cyan toner (C), or a black toner (Bk), as well as a carrier, respectively. The two-component developer incorporates a carrier in which an insulating resin is coated around ferrite as a core and a clear toner used in the present invention or a toner of each color containing a binder resin and a colorant such as a pigment or carbon black, a charge regulator, silica, and titanium oxide.

The carrier has, for example an average particle diameter of 10 to 50 μm and a saturated magnetization of 10 to 80 emu/g. The toner has a particle diameter of 4 to 10 μm. The charging characteristics of the toners used in the image forming apparatus shown in FIG. 7 including the clear toner are negative charging characteristics and the average charge amount is preferably −20 to −60 μC/g. For such a two-component developer, a carrier and a toner as described above are mixed and prepared so as for the toner concentration to be 4% by mass to 10% by mass.

The intermediate transfer belt 26 is rotatably supported by a plurality of rollers. The intermediate transfer belt 26 is a belt of an endless shape, for example, having a volume resistance of $10^6$ to $10^{12}$ Ω·cm. The intermediate transfer belt 26 can be formed using a resin material such as, e.g., polycarbonate (PC), polyimide (PI), polyamide-imide (PAI), polyvinylidene fluoride (PVDF), or tetrafluoroethylene-ethylene copolymer (ETFE). The thickness of the intermediate transfer belt 26 is preferably 50 to 200 μm.

A clear toner layer and individual color toner images having been formed on the photoreceptors 21, 21Y, 21M, 21C, and 21Bk by the clear toner layer forming section 20 and the tone image forming sections 20Y, 20M, 20C, and 20Bk each are sequentially transferred onto the rotating intermediate transfer belt 26 by the primary transfer rollers 27, 27Y, 27M, 27C, and 27Bk (primary transfer) to form a clear toner layer and a composed full-color image on the intermediate transfer belt 26. On the other hand, after image transfer, from the photoreceptors 21Y, 21M, 21C, and 21Bk, the residual toners are eliminated by the cleaning device 25 (25S, 25Y, 25M, 25C, and 25Bk), respectively.

A transfer medium P having been stored in a sheet storage section (a tray) of the sheet feeding device 40 is fed by a first sheer feeding section, passed through a sheet feeding roller registration miler (a second sheet feeding section), and conveyed to a secondary transfer roller 29 to transfer the clear toner layer and the color image onto the transfer medium P (secondary transfer).

Since three-stage sheet storage sections longitudinally arranged in the vertical direction in the lower portion of the image forming apparatus 3 have almost the same constitution, the same symbol is assigned thereto. Further, since 3-stage sheet feeding sections also have almost the same constitution, the same symbol is assigned thereto. The sheet storage sections and the sheet feeding sections are collectively referred to as a sheet feeding device 40.

With regard to the clear toner layer and the full-color image having been transferred to the image support P, the clear toner layer and the tone image are heated/pressed, melted and solidified by the glossy surface forming device 1 for glossy surface formation and toner image fixing, and fixed on the image support P by the device having formed the glossy surface and the toner image. The image support P is discharged from the image forming apparatus 3 to be stacked on the sheet discharging tray 90 outside the apparatus.

On the other hand, the clear toner layer and the full-color toner image are transferred onto the image support P by the secondary transfer roller 29, and thereafter, from the intermediate transfer belt 26 having curvature-separated the image support P, the residual toner is eliminated by the intermediate transfer belt cleaning device 261.

As described above, the image forming apparatus 3 shown in FIG. 7 can form a full-color image having a glossy surface on an image support P. In this manner, in the image forming apparatus 3 of FIG. 7, a glossy surface forming device 1 is arranged, and then a clear toner layer CT and a full-color toner image having been transferred on an image support P by the secondary transfer roller 29 can be simultaneously fixed by the glossy surface forming device 1. Further, the image forming apparatus of FIG. 7 can has a configuration in which the glossy surface forming device 1 is incorporated in the image forming apparatus 2, which is preferable in view of the realization of size reduction of the apparatus.

Next, an image support usable in the present invention will be described. The image support usable in the present invention includes, for example, plain paper, being thin to thick, bond paper, art paper, and coated printing paper such as coated paper, as well as commercially available Japanese paper and postcard paper, OHP plastic films, and cloths. These image supports are usable as is but also usable after image formation via a well-known method.

A clear toner usable in the present invention, as described above, incorporates a colorless, transparent resin particle which does not contain a colorant (for example, a coloring pigment, a coloring dye, black carbon particles, and black magnetic powder) colored via the action of light absorption or light scattering. The production method of a clear toner usable in the present invention is not specifically limited and any appropriate toner production method used for an electrophotographic image forming method is applicable. Namely, applicable is a toner production method via a so-called pulverization method in which a toner is produced via kneading, pulverization, and classification steps, or a so-called polymerization method in which a polymerizable monomer is polymerized and simultaneously with control of the shape and the size, particles are formed.

EXAMPLES

The embodiment of the present invention will now specifically be described with reference to examples. "Parts" in the following description represent "parts by mass."

1. Production of "Clear Toner 1" and "Clear Toner Developer 1"

Via a production step of resin fine particles using a multi-stage polymerization method and a coagulation/fusion step using an emulsion association method, "clear toner 1" was produced.

1-1. Production of "Resin Fine Particle 1B"

As described below, via three-stage polymerization reaction, i.e., by a multi-stage polymerization method, "resin fine particle 1B" was produced.

(1) First-Stage Polymerization

In a reaction container fitted with a stirrer, a temperature sensor, a condenser tube, and a nitrogen introducing device, 5 parts by mass of sodium polyoxyethylene(2)dodecyl sulfate and 800 parts by mass of ion exchange water were placed for temperature elevation up to 83° C. with stiffing under nitrogen current.

After temperature elevation, a monomer mixed solution containing the following compounds was added, and using a mechanical homogenizer equipped with a circulation path, "CLEAR MIX (produced by M Technique Co., Ltd.), mixing/dispersion was carried out for 1 hour to prepare a dispersion liquid containing emulsified particles (oil droplets). The monomer mixed solution contains the following compounds.

| | |
|---|---|
| Styrene | 273 parts by mass |
| n-Butyl acrylate | 63 parts by mass |
| Methacrylic acid | 30 parts by mass |
| Paraffin wax | 113 parts by mass |
| n-Octylmercaptan | 5.4 parts by mass |

Subsequently, an initiator solution in which 12 parts by mass of potassium persulfate (KPS) was dissolved in 230 parts by mass of ion exchange water was added to the above dispersion liquid and the liquid temperature was raised up to 82° C. for polymerization reaction by heating for 1 hour with stirring to produce a dispersion liquid of "resin fine particle 1A."

(2) Second-Stage Polymerization

An initiator solution in which 10 parts by mass of potassium persulfate (KPS) was dissolved in 200 parts by mass of ion exchange water was added to above "resin fine particle 1A" and thereafter a monomer mixed solution containing the following compounds was dripped over 1.5 hours at 82° C.

| | |
|---|---|
| Styrene | 442 parts by mass |
| n-Butyl acrylate | 102 parts by mass |
| n-Octylmercaptan | 7.5 parts by mass |

After dripping of the monomer mixed solution, heating/stirring was carried out at 82° C. for 2 hours for polymerization reaction. Then, the liquid temperature was decreased down to 28° C. to produce a dispersion liquid of "resin fine particle 1B."

1-2. Production of "Clear Toner 1"

(1) Coagulation/Fusion Step

A reaction container fitted with a stirrer, a temperature sensor, a condenser tube was charged with the following materials to be stirred.

| | |
|---|---|
| "Resin fine particle 1B" | 450 parts by mass (in terms of the solid content) |
| Ion exchange water | 900 parts by mass |
| Sodium polyoxyethylene(2)dodecyl ether sulfate | 2 parts by mass |

The temperature inside the reaction container was adjusted at 25° C., followed by addition of 25% by mass of a sodium hydroxide aqueous solution to adjust the pH at 10.

Subsequently, an aqueous solution, in which 70 parts by mass of magnesium chloride-6 hydrate was dissolved in 105 parts by mass of ion exchange water, was added at 30° C. over 10 minutes with stirring, followed by being allowed to stand for 3 minutes to initiate temperature elevation. The system temperature was raised up to 85° C. over 60 minutes and then above "resin fine particle 1B" continued to be coagulated/fused at a maintained temperature of 85° C. In this state, using "MULTISIZER 3 (produced by Beckman Coulter, Inc.)," the particle diameter of coagulated particles which were being formed was determined. Then, when the volume based median diameter of the coagulated particles reached 6.7 μm, an aqueous solution, in which 73 parts by mass of sodium chloride was dissolved in 290 parts by mass of ion exchange water, was added to terminate coagulation.

After termination of coagulation, for ripening treatment, the liquid temperature was raised up to 88° C., and then heating/stirring was carried out as using "FPIA-2100 (produced by Sysmex Corp.), the circularity of the coagulated particles was determined. When the average circularity reached 0.960, fusion of coagulated "resin fine particle 1B" was allowed to advance. In this manner, "toner host particle 1" was formed and then the liquid temperature was decreased down to 30° C. Then, using hydrochloric acid, the pH in the liquid was adjusted at 2 to terminate stirring.

(2) Washing/Drying Step

"Toner host particle 1" having been produced via the above step was subjected to solid liquid separation using basket-type centrifuge "MARK III Model No. 60×40 (produced by Matsumoto Machine Mfg. Co., Ltd.)" to form a wet cake of "toner host particle 1." This wet cake was washed with ion exchange water of 45° C. using the basket-type centrifuge until the electrical conductivity of the filtrate reached 5 μS/cm and then transferred to "FLASH JET DRYER (produced by Seishin Enterprise Co., Ltd.)." Drying treatment was carried out until the water content reached 1.0% by mass.

(3) External Additive Addition Step

The following external additives were added to 100 part by mass of "toner hast particle 1" having been dried, and then using "HENSCHEL MIXER (produced by Mitsui Miike Engineering Co., Ltd.)," external addition treatment was carried out to produce "clear toner 1."

| | |
|---|---|
| Silica treated with hexamethylsilazane (average primary particle diameter: 12 nm, hydrophobization degree: 68) | 1.0 parts by mass |
| Titanium dioxide treated with n-octylsilane (average primary particle diameter: 20 nm, hydrophobization degree: 63) | 0.3 parts by mass |

After the above external addition treatment, using a sieve of a mesh opening of 45 μm, coarse particles were eliminated to produce "clear toner 1."

Preparation of "Clear Toner Developer 1"

"Clear toner 1" was mixed with a ferrite carrier of a volume average particle diameter of 40 μm covered with a methyl methacrylate resin so that the clear toner concentration became 6% by mass to prepare "clear toner developer 1" having a 2-component developer form.

2. Procedures of Glossy Surface Formation 2-1. Formation of "Clear Toner Layers 1 to 13"

(1) Setting of Clear Toner Layer Forming Conditions

Image supports P on which a toner image, an ink-jet image, and a plate-making processed image have been formed were processed using a clear toner layer forming device having the constitution shown in FIG. 4 to form a clear toner layer having a shape to be described later on the image supports P. Formation of such a clear toner layer was realized by making the following settings for the control device (a computer) of the clear toner layer forming device. Namely, a program, in which a plurality of pieces of pattern information including FIGS. 1A-1D were provided; of these pieces of pattern information, any pattern was selected; and the selected pattern was exposed on the photoreceptor using the latent image writing section, was stored in the control device (a computer) in advance. Further, with regard to the width W, the distance D, and the intersecting angle θ of protrusion portions T constituting the pattern, the control device was set so as for the operator to input appropriate values.

Further, as the image support P, commercially available A4 size coated printing paper "OK TOP COAT+(basis weight: 157 g/m$^2$, sheet thickness: 131 μm) (produced by Oji Paper Co., Ltd.) was used.

The image forming apparatuses used to form each image are as follows:

(a) Electrophotographic system: "bizhub C353 (produced by Konica Minolta Business Technologies, Inc.)"

(b) Ink-jet system: "ink-jet printer PX-5800 (produced by Seiko Epson Corp.)"

(c) Plate-making system: "RISO digital screen maker SP400D (produced by Riso Kagaku Corp.)"

An image formed using any of the above image forming apparatuses was output on a single image support by being divided into quarters having a solid image having a density of 1.5 based on a Macbeth densitometer, a halftone image having a density of 0.8 also based on the Macbeth densitometer, a white background image, and a portrait photographic image.

(2) Production of "Clear Toner Layers 1 to 11"

Using the above computer, pieces of pattern information such as FIGS. 1*a* to 1*d* were selected and also the width W, the distance D, and the intersecting angle θ of protrusion portions T were set as needed as shown in Table 1 to be described later to produce "clear toner layers 1 to 11." Each toner layer was formed on the entire areas of image supports P on which a toner image, an ink jet image, and a plate-making processed image as described above have been formed. The feed amount of the clear toner was 6 g/m$^2$.

(3) Production of "Clear Toner Layers 12 and 13"

"Clear tone layer 12" in which protrusion portions T were formed in the direction vertical to the conveyance direction of the image support was produced in the same manner as in formation of the above clear toners except that of the setting conditions of the computer to form "clear toner layer 5," the intersecting angle θ was changed to 90°. Further, "clear toner layer 13" in which no linear protrusion portions were formed was produced in such a manner that neither selection of pattern information nor condition setting for the width and distance of protrusion portions was made using the computer.

A clear toner layer pattern of each of "clear toner layers 1-13" formed on the image supports via the above procedures, as well as the intersecting angle θ, the width W, and the distance D of protrusion portions T are shown in Table 1.

TABLE 1

| Clear Toner Layer No. | Clear Toner Layer Pattern | Intersecting Angle θ (°) | Protrusion Portion Width W (μm) | Protrusion Portion Distance D (μm) | Clear Toner Adhesion Amount (g/m$^2$) | Relational Expression of Claim 4 |
|---|---|---|---|---|---|---|
| 1 | FIG. 1a | 0 | 50 | 30 | 6 | not satisfied |
| 2 | FIG. 1b | 45 | 50 | 100 | 6 | not satisfied |
| 3 | FIG. 1a | 0 | 50 | 200 | 6 | not satisfied |
| 4 | FIG. 1a | 0 | 100 | 150 | 6 | not satisfied |
| 5 | FIG. 1b | 45 | 200 | 100 | 6 | not satisfied |
| 6 | FIG. 1d | 45 | 300 | 150 | 6 | satisfied |
| 7 | FIG. 1c | 45 | 400 | 200 | 6 | not satisfied |
| 8 | FIG. 1a | 0 | 200 | 150 | 6 | satisfied |
| 9 | FIG. 1c | 60 | 200 | 150 | 6 | satisfied |
| 10 | FIG. 1b | 30 | 200 | 150 | 6 | satisfied |
| 11 | FIG. 1b | 80 | 100 | 50 | 6 | not satisfied |
| 12 | — | 90 | 200 | 100 | 6 | not satisfied |
| 13 | — | — | — | — | — | — |
| 14 | FIG. 1b | 45 | 200 | 100 | 4 | satisfied |
| 15 | FIG. 1b | 45 | 400 | 200 | 8 | satisfied |

2-2. Forming Conditions of Glossy Surfaces

Image supports having been produced using the clear toner layer forming device having the constitution shown in FIG. 4 each were processed by a glossy surface forming device having the constitution shown in FIG. 5 to form a glossy surface on each of the image supports P having a toner image, an ink-jet image, and a plate-making processed image. In glossy surface formation using the glossy surface forming device shown in FIG. 5, each of the image supports was fed to the glossy surface forming device so that glossy surface formation was carried out under the same conditions for the image supports having a toner image, an ink-jet image, and a plate-making processed image. In other words, image supports were set so that the glossy surface forming device performed glossy surface formation in the order of the image support with an electrophotographic image, the image support with an ink-jet image, and the image support with a plate-making processed image. Then, glossy surface formation was continuously carried out on 3000 image supports in total, in which 1000 sheets thereof each were allocated for each image.

Herein, those in which on the image supports on which "clear toner layers 1 to 11" have been formed, a glossy surface was formed via processing of the glossy surface forming device having the constitution shown in FIG. 4 are designated as "Examples 1 to 11". Further, those in which on the image supports on which "clear toner layers 12 and 13" have been formed, a glossy surface was formed using the glossy surface forming device having the constitution shown in FIG. 4 are designated as "Comparative Examples 1 and 2".

Figure 8:
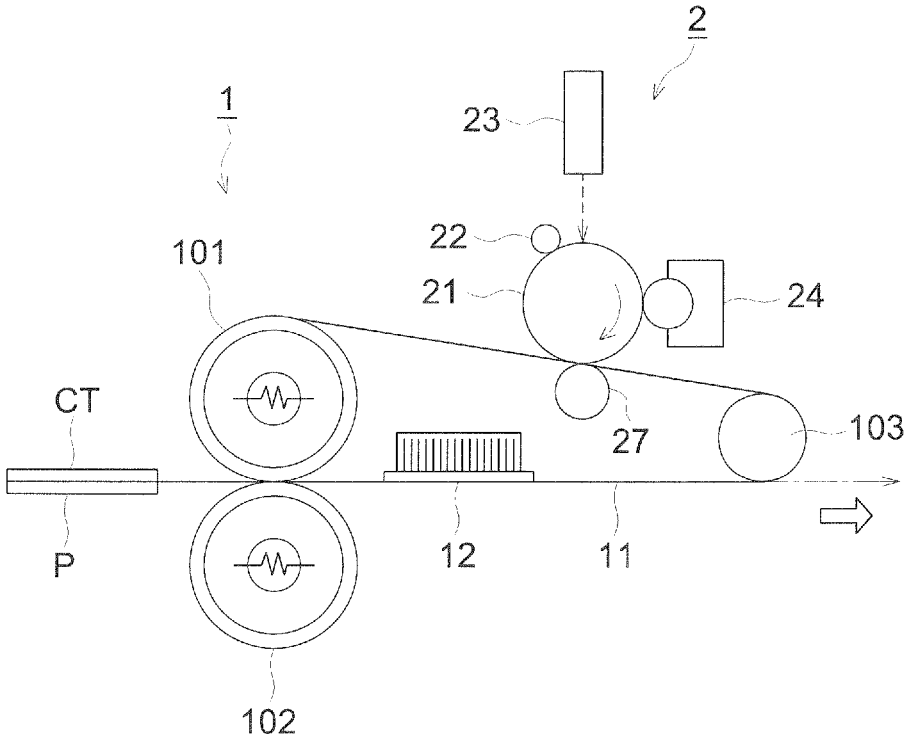
FIG. 8 is a cross-section constitutional view of an image forming apparatus used to carry out clear toner layer formation and glossy surface formation on an image support in Comparative Examples 3 and 4.

Further, those in which using the method disclosed in Unexamined Japanese Patent Application Publication No. 2003-316192 shown in FIG. 8, above clear toner layers 5 and 8 were formed, and while each of the clear toner layers was heated and melted, an image support was fed thereto to form a glossy surface are designated as "Comparative Examples 3 and 4". In "Comparative Example 3," on the fixing belt of the glossy surface forming device, above "clear toner layer 5" was directly formed and while "clear toner layer 5" having been formed on the fixing belt was heated and melted, an image support was fed thereto, followed by transfer and cooling to form a glossy surface. In "Comparative Example 4," "clear toner layer 8" was directly formed on the fixing belt of the glossy surface forming device shown in FIG. 8 to form a glossy surface on an image support in the same manner as for "Comparative Example 3."

The following specifications were set for the glossy surface forming device shown in FIG. 5 for glossy surface formation described above.

(a) Specifications on the Heating and Pressing Rolls

Heating roll: aluminum base body of an outer diameter of 100 mm and a thickness of 10 mm Pressing roll: A silicone rubber layer was arranged on an aluminum base body of an outer diameter of 80 ram and a thickness of 10 mm.

Inside the heating roll and the pressing roll each, a halogen lamp was arranged and the roll surface temperatures of the heating roll and the pressing roll were set at 155° C. and 115°, respectively (Temperature was controlled using a thermistor).

Nip width between the heating roll and the pressing roll: 11 mm (b) Image support temperature at the location of the separating roll: set at 40±5° C.

(c) Distance from the heating/pressing roll nip section to the separating roll location: 620 mm (d) Image support conveyance velocity: 220 mm/second (e) Image support conveyance direction: the image support longitudinal direction of A4 size (refer to FIG. 1*a*)

(f) Evaluation ambience: normal temperature/normal humidity (temperature: 20° C., relative humidity: 50% RH)

Further, the fixing belt of the device shown in FIG. 8 used for glossy surface formation of "Comparative Examples 3 and 4" was the same as one used to form the clear toner layers in "Examples 1 to 11," and specifications on the heating roll and the pressing roll were the same as the above ones.

3. Evaluation Experiments

Using the image supports on which a glossy surface had been formed via the above procedures, as described below, air bubble generation state, open space disappearance state between protrusion portions, glossy surface staining, and transferability variation were evaluated.

(1) Evaluation on "Air Bubble Generation State" and "Open Space Disappearance State Between Protrusion Portions With regard to the glossy surfaces of the surfaces of image supports produced at the initiation of glossy surface formation, and approximately as the 1000th sheet and as the 3000th sheet in which a toner image, an ink-jet image, and a plate-making processed image were output, "air bubble generation evaluation" and evaluation on "open space disappearance state between protrusion portions" were conducted. In "air bubble generation evaluation," "presence or absence of clouded areas" was visually evaluated and also using a commercially available digital microscope, surface observation of a glossy surface was made, followed by calculation of the ratio of air bubble areas occupied in a certain area for quantitative evaluation. Further, "open space disappearance state between protrusion portions" was evaluated using a magnifying glass of a magnification of 10 times. For each of "presence or absence of clouded areas" and "open space disappearance state between protrusion portions," "absence" was evaluated to be accepted and "presence" was evaluated to be unaccepted. Then, "image clarity evaluation" was conducted via the following procedures.

<Image Clarity Evaluation>

Figure 9:
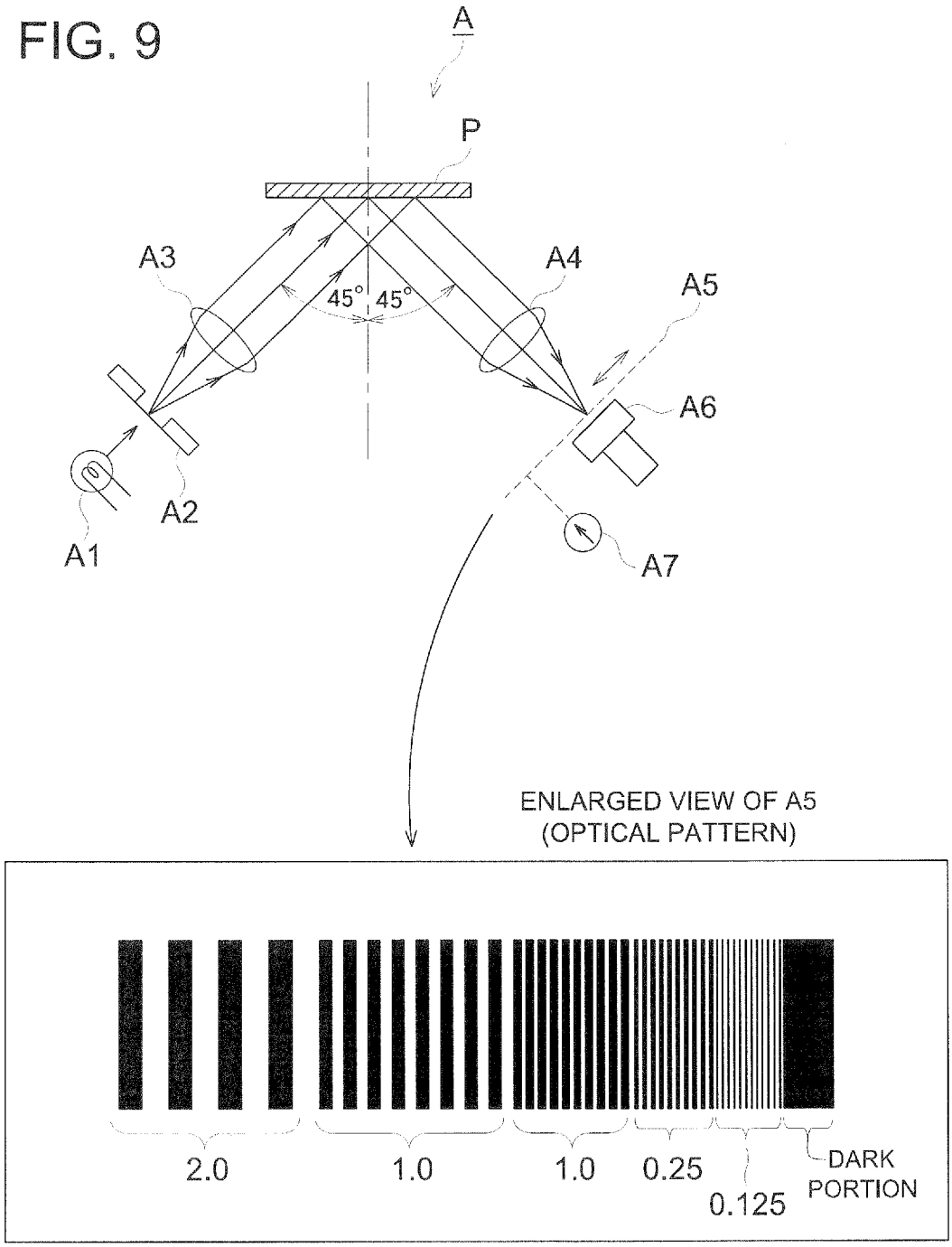
FIG. 9 is a schematic view showing the principle of image clarity C value determination using a TM-type image clarity measurement device.

"Image clarity" was evaluated based on the following procedures. Herein, "image clarity" is one of the evaluation methods of glossiness and quantitatively evaluates how mush sharpness an image having been reflected exhibits and whether or not the image is shown without distortion when the image is reflected on the clear toner layer surface depending on light. Specifically, using a measurement device referred to as a TM-type image clarity measurement device, evaluation is conducted based on a numerical value specified in percentage referred to as image clarity C value. Larger image clarity C value indicates more excellent glossiness. The principle of image clarity C value determination using the TM-type image clarity measurement device is shown in FIG. 9.

In the present evaluation, evaluation was conducted by calculating the image clarity C value of an optical comb image of a width of 2 mm reflected on the glossy surface formed, by the glossy surface forming device shown in FIG. 5, on an image having been formed on a transfer medium P using an image forming apparatus. Specifically, using commercially available TM-type image clarity measurement device "ICM-1T" (produced by Suga Test Instruments, Co., Ltd.), with respect to an optical comb image of a width of 2 mm, 45-degree image clarity C value was measured at a measurement angle of 45°, followed by calculation to carry out evaluation based on the following criteria. Measurement using the TM-type image clarity measurement device was carried out with a measurement hole of 20 mm and a power capacity of a 100 V/2 A single phase, and calibration was carried out based on black plate glass "OPTIC STANDARDS (reflection measurement: 45°/65°) serving as a standard plate for management of the measurement device.

A 45-degree image clarity C value of at least 40 was evaluated to be accepted, and especially, a value of at least 70 was evaluated to be excellent and a value of 60 to less than 70 was evaluated to be good.

With regard to the above "open space disappearance state between protrusion portions," evaluation was conducted with respect to the fact that no adverse effect on glossy surface finishing was produced even when minute areas with no clear toner were intentionally formed within a clear toner layer.

(2) Evaluation of "Image Staining" and "Transfer Failure"

Using the glossy surfaces of the surfaces of image supports produced approximately as the 1000th sheet and as the 3000th sheet during glossy surface formation in which a toner image, an ink-jet image, and a plate-making processed image were output, "image staining" and "transfer failure" were evaluated as described below.

<Evaluation of Image Staining>

A glossy surface formed on the half tone image portion, the white background portion, and the portrait photographic image was visually observed and evaluation was conducted based on the number of black spot stained locations. "Black spot staining" is generated in such a manner that clear toner pieces remaining on the belt member are repeatedly heated to result in a melt and the thus-produced melt is transferred to the pressing roller to adhere to the rear face of the image support. The state with at most 7 black spot stained locations was evaluated to be accepted and the state with 0 to 3 was evaluated to be excellent.

<Evaluation of Transfer Failure>

A glossy surface formed on the solid image portion and the halftone image portion was visually observed to evaluate the state of spot defect occurrence on the glossy surface. It is presumed that "a spot defect" occurs in such a manner that the melt of clear toner pieces remains on the belt member and thereby a fresh clear toner cannot be transferred to the location. The state with at most 10 spot defects was evaluated to be accepted and the state with 0 to 5 spot defects was evaluated to be excellent.

With regard to above results, the evaluation results of the glossy surfaces formed on the toner image, the evaluation results of the glossy surfaces formed on the ink-jet image, and the evaluation results of the glossy surfaces formed the plate-making processed image are shown in Table 2, Table 3, and Table 4, respectively.

TABLE 2

| | Clear | Presence or Absence of Clouded Areas | | | Image Clarity Evaluation | | | Open Space between | Image Staining | | Transfer Failure | |
|---|---|---|---|---|---|---|---|---|---|---|---|---|
| | Toner Layer No. | At Initiation | 1000th Sheet | 3000th Sheet | At Initiation | 1000th Sheet | 3000th Sheet | Convex Portions | 1000th Sheet | 3000th Sheet | 1000th Sheet | 3000th Sheet |
| Example 1 | 1 | absent | absent | absent | 75 | 70 | 64 | absent | 2 | 6 | 3 | 8 |
| Example 2 | 2 | absent | absent | absent | 74 | 69 | 62 | absent | 3 | 5 | 2 | 7 |
| Example 3 | 3 | absent | absent | absent | 75 | 70 | 65 | absent | 2 | 4 | 2 | 8 |
| Example 4 | 4 | absent | absent | absent | 76 | 73 | 71 | absent | 1 | 3 | 0 | 3 |
| Example 5 | 5 | absent | absent | absent | 76 | 74 | 73 | absent | 0 | 0 | 0 | 1 |
| Example 6 | 6 | absent | absent | absent | 83 | 80 | 79 | absent | 0 | 2 | 1 | 3 |
| Example 7 | 7 | absent | absent | absent | 75 | 70 | 65 | absent | 2 | 4 | 2 | 7 |
| Example 8 | 8 | absent | absent | absent | 82 | 81 | 81 | absent | 0 | 1 | 0 | 1 |
| Example 9 | 9 | absent | absent | absent | 82 | 82 | 80 | absent | 0 | 0 | 0 | 1 |
| Example 10 | 10 | absent | absent | absent | 83 | 81 | 80 | absent | 0 | 1 | 0 | 0 |
| Example 11 | 11 | absent | absent | absent | 74 | 69 | 62 | absent | 3 | 6 | 3 | 8 |
| Example 12 | 14 | absent | absent | absent | 81 | 81 | 80 | absent | 1 | 2 | 0 | 1 |
| Example 13 | 15 | absent | absent | absent | 77 | 76 | 71 | absent | 2 | 3 | 1 | 2 |
| Comparative Example 1 | 12 | present | present | present | 58 | 46 | 35 | absent | 2 | 7 | 3 | 8 |
| Comparative Example 2 | 13 | present | present | present | 56 | 45 | 33 | absent | 3 | 7 | 4 | 9 |
| Comparative Example 3 | 5 | absent | present | present | 70 | 58 | 38 | absent | 6 | 12 | 11 | 17 |
| Comparative Example 4 | 8 | absent | present | present | 71 | 58 | 37 | absent | 6 | 13 | 12 | 18 |

TABLE 3

| | Clear | Presence or Absence of Clouded Areas | | | Image Clarity Evaluation | | | Open Space between | Image Staining | | Transfer Failure | |
|---|---|---|---|---|---|---|---|---|---|---|---|---|
| | Toner Layer No. | At Initiation | 1000th Sheet | 3000th Sheet | At Initiation | 1000th Sheet | 3000th Sheet | Convex Portions | 1000th Sheet | 3000th Sheet | 1000th Sheet | 3000th Sheet |
| Example 1 | 1 | absent | absent | absent | 74 | 69 | 63 | absent | 3 | 7 | 4 | 9 |
| Example 2 | 2 | absent | absent | absent | 74 | 68 | 63 | absent | 3 | 6 | 3 | 8 |
| Example 3 | 3 | absent | absent | absent | 75 | 69 | 64 | absent | 3 | 5 | 3 | 7 |
| Example 4 | 4 | absent | absent | absent | 75 | 72 | 70 | absent | 0 | 2 | 0 | 2 |
| Example 5 | 5 | absent | absent | absent | 76 | 75 | 74 | absent | 0 | 0 | 0 | 0 |
| Example 6 | 6 | absent | absent | absent | 82 | 81 | 79 | absent | 0 | 3 | 1 | 3 |
| Example 7 | 7 | absent | absent | absent | 75 | 70 | 65 | absent | 3 | 5 | 3 | 8 |
| Example 8 | 8 | absent | absent | absent | 82 | 80 | 80 | absent | 0 | 0 | 0 | 0 |
| Example 9 | 9 | absent | absent | absent | 83 | 80 | 79 | absent | 0 | 0 | 0 | 1 |
| Example 10 | 10 | absent | absent | absent | 83 | 81 | 81 | absent | 0 | 0 | 0 | 0 |
| Example 11 | 11 | absent | absent | absent | 74 | 70 | 61 | absent | 3 | 7 | 4 | 9 |
| Example 12 | 14 | absent | absent | absent | 80 | 79 | 79 | absent | 2 | 4 | 1 | 3 |
| Example 13 | 15 | absent | absent | absent | 77 | 76 | 73 | absent | 1 | 3 | 2 | 3 |
| Comparative Example 1 | 12 | present | present | present | 58 | 46 | 36 | absent | 2 | 6 | 4 | 8 |
| Comparative Example 2 | 13 | present | present | present | 56 | 45 | 31 | absent | 4 | 7 | 3 | 8 |
| Comparative Example 3 | 5 | absent | present | present | 71 | 60 | 36 | absent | 9 | 14 | 12 | 19 |
| Comparative Example 4 | 8 | absent | present | present | 71 | 59 | 38 | absent | 8 | 15 | 11 | 20 |

TABLE 4

| | Clear | Presence or Absence of Clouded Areas | | | Image Clarity Evaluation | | | Open Space between | Image Staining | | Transfer Failure | |
|---|---|---|---|---|---|---|---|---|---|---|---|---|
| | Toner Layer No. | At Initiation | 1000th Sheet | 3000th Sheet | At Initiation | 1000th Sheet | 3000th Sheet | Convex Portions | 1000th Sheet | 3000th Sheet | 1000th Sheet | 3000th Sheet |
| Example 1 | 1 | absent | absent | absent | 76 | 71 | 64 | absent | 4 | 7 | 4 | 8 |
| Example 2 | 2 | absent | absent | absent | 73 | 69 | 63 | absent | 3 | 6 | 3 | 8 |
| Example 3 | 3 | absent | absent | absent | 75 | 71 | 65 | absent | 2 | 5 | 3 | 8 |
| Example 4 | 4 | absent | absent | absent | 76 | 72 | 70 | absent | 1 | 3 | 0 | 2 |
| Example 5 | 5 | absent | absent | absent | 76 | 75 | 74 | absent | 0 | 0 | 0 | 1 |
| Example 6 | 6 | absent | absent | absent | 81 | 80 | 80 | absent | 0 | 3 | 1 | 2 |
| Example 7 | 7 | absent | absent | absent | 74 | 70 | 65 | absent | 2 | 4 | 3 | 6 |
| Example 8 | 8 | absent | absent | absent | 82 | 81 | 80 | absent | 0 | 0 | 0 | 0 |
| Example 9 | 9 | absent | absent | absent | 82 | 82 | 81 | absent | 0 | 0 | 0 | 0 |
| Example 10 | 10 | absent | absent | absent | 83 | 82 | 81 | absent | 0 | 0 | 0 | 1 |
| Example 11 | 11 | absent | absent | absent | 74 | 70 | 62 | absent | 4 | 7 | 5 | 9 |
| Example 12 | 14 | absent | absent | absent | 81 | 81 | 80 | absent | 2 | 2 | 1 | 2 |
| Example 13 | 15 | absent | absent | absent | 78 | 75 | 72 | absent | 1 | 3 | 0 | 2 |
| Comparative Example 1 | 12 | present | present | present | 57 | 47 | 35 | absent | 4 | 7 | 4 | 9 |
| Comparative Example 2 | 13 | present | present | present | 56 | 48 | 33 | absent | 3 | 6 | 5 | 10 |
| Comparative Example 3 | 5 | absent | present | present | 71 | 59 | 37 | absent | 8 | 15 | 13 | 21 |
| Comparative Example 4 | 8 | absent | present | present | 71 | 58 | 36 | absent | 9 | 16 | 11 | 19 |

Table 2 to Table 4 show that in each of "Examples 1 to 11" having a glossy surface formed with a clear toner layer having been formed under conditions having the constitution of the present invention, any clouded area did not appeared on the glossy surface and excellent image clarity was realized, and further, no clear toner layer defect occurred on the glossy surface associated with image staining or image transfer failure even when glossy surface formation was repeated.

In contrast, in the results of "Comparative Examples 1 and 2," clouded area occurrence was markedly observed on the glossy surface and also image clarity was less than the level of acceptance. Further, in "Comparative Examples 3 and 4," image staining and transfer failure were markedly noted and also an adverse effect resulting from contamination by the residual clear toner due to direct formation of a clear toner layer on the fixing belt member was markedly produced. Still further, in "Comparative Examples 3 and 4," minor clouded areas occurred on the glossy surface although its level was lower than that of "Comparative Examples 1 and 2," resulting then in an adverse affect on image clarity. The reason is presumed as follows: since a melted clear toner layer was transferred onto an image support, air was also taken in along with the thus-melted clear toner layer, and thereby the caught air could not move from the clear toner layer and remained, resulting in occurrence of minute air bubbles.

The invention claimed is:

1. An image forming method comprising steps of;

forming a clear toner layer on a photoreceptor, transferring the clear toner layer having been formed on the photoreceptor onto a transfer member, transferring the clear toner layer having been transferred on the transfer member onto an image support, heating the image support on which the clear toner layer has been transferred, bringing the face on the side of the image support on which the clear toner layer has been transferred into close contact with a belt and to cool the image support on which the clear toner layer has been transferred in the state of being in close contact with the belt, and separating the image support on which the clear toner layer has been transferred from the belt are provided, in this order, wherein the clear toner layer is formed with a plurality of independent linear protrusion portions and the independent linear protrusion portions are formed parallel or diagonally to the conveyance direction of the image support.

2. The image forming method of claim 1, wherein the plurality of linear protrusion portions are arranged so as to penetrate from one end side of the image support toward the other end side.

3. The image forming method of claim 1 wherein the plurality of linear protrusion portions are arranged so as to have a width W of 100 μm to 300 μm and a distance D of 50 μm to 150 μm.

4. The image forming method of claim 1, wherein a clear toner feed amount x, and a width W and a distance D of the protrusion portions satisfy the relationship of $$0.0008D^2-0.12D+12 \geq x(D+W)/W \geq 0.0004D^2-0.06D+6,$$

wherein x is clear toner feed amount during formation of a clear toner layer in $g/m^2$, and W and D are width and distance of protrusion portions constituting the clear toner layer in μm, respectively.

5. An image forming apparatus having a clear toner layer forming device to transfer a clear toner layer onto an image support, a glossy surface forming device to form a glossy surface on an image support on which the clear toner layer has been transferred by the clear toner layer forming device, and a control device to control electrostatic latent image pattern data of a clear toner layer, wherein the clear toner layer forming device comprises a photoreceptor, an exposure member to expose the photoreceptor, a clear toner feeding member to feed a clear toner to the photoreceptor on which a latent image has been formed by the exposure member, and a transfer member to transfer a clear toner layer having been formed on the photoreceptor by the clear toner feeding member onto an image support;

the glossy surface forming device comprises a heating member to heat the image support on which the clear toner layer having been formed by the clear toner layer forming device, a belt member with which the image support is brought into close contact via the clear toner layer having been melted via heating by the heating member, a cooling member to cool the image support in the state of being in close contact with the belt member, and a separating member to separate the image support in which the clear toner layer has been solidified via cooling by the cooling member from the belt member; and the control device controls operation of the clear toner layer forming device so that a clear toner layer formed on the photoreceptor has a plurality of independent linear protrusion portions and when the clear toner layer is transferred onto an image support, the plurality of independent linear protrusion portions are formed parallel or diagonally to the conveyance direction of the image support.

6. The image forming apparatus of claim 5, wherein the plurality of linear protrusion portions are arranged so as to penetrate from one end side of the image support toward the other end side.

7. The image forming apparatus of claim 5, wherein the plurality of linear protrusion portions are arranged so as to have a width W of 100 μm to 300 μm and a distance D of 50 μm to 150 μm.

8. The image forming apparatus of claim 5, wherein a clear toner feed amount x, and a width W and a distance D of the protrusion portions satisfy the relationship of $$0.0008D^2-0.12D+12 \geq x(D+W)/W \geq 0.0004D^2-0.06D+6,$$

wherein x is clear toner feed amount during formation of a clear toner layer in $g/m^2$, and W and D are width and distance of protrusion portions constituting the clear toner layer in μm, respectively.

* * * * *